US005983413A

United States Patent [19]

Hayashi et al.

[11] Patent Number: 5,983,413

[45] Date of Patent: Nov. 16, 1999

[54] HIGH PERFORMANCE FLUSH TOILET

[75] Inventors: Ryosuke Hayashi; Ken Wijaya; Kinya Arita; Ryoichi Tsukada; Shinji Shibata; Hiroyuki Matsushita, all of Kitakyushu, Japan

[73] Assignee: Toto Ltd., Kanagawa, Japan

[21] Appl. No.: 09/035,092

[22] Filed: Mar. 5, 1998

Related U.S. Application Data

[63] Continuation-in-part of application No. 08/860,419, filed as application No. PCT/JP95/02722, Dec. 27, 1995.

[30] Foreign Application Priority Data

| | | | |
|---|---|---|---|
| Dec. 28, 1994 | [JP] | Japan | 6-328664 |
| Apr. 11, 1995 | [JP] | Japan | 7-85780 |
| Jun. 19, 1995 | [JP] | Japan | 7-151882 |

[51] Int. Cl.[6] ..... E03D 11/00

[52] U.S. Cl. ..... 4/420; 4/415; 4/424

[58] Field of Search ..... 4/420, 415, 324, 4/325, 421, 424, 425, 428, DIG. 13

[56] References Cited

U.S. PATENT DOCUMENTS

| | | | |
|---|---|---|---|
| 1,964,876 | 7/1934 | Gavin | 4/73 |
| 2,129,398 | 9/1938 | Beam | 4/73 |
| 3,086,217 | 4/1963 | Barlow | 4/41 |
| 3,484,873 | 12/1969 | Hoard et al. | 6/69 |
| 4,197,599 | 4/1980 | Tsai | 4/424 |
| 4,945,578 | 8/1990 | Jomha et al. | 4/324 |
| 5,040,247 | 8/1991 | Stevens | 4/324 |
| 5,142,712 | 9/1992 | Hennessy | 4/431 |
| 5,204,999 | 4/1993 | Makita et al. | 4/300 |
| 5,293,650 | 3/1994 | Schoepe et al. | 4/379 |
| 5,341,522 | 8/1994 | Munro | 4/324 |
| 5,502,845 | 4/1996 | Hayashi et al. | 4/300 |

FOREIGN PATENT DOCUMENTS

| | | | |
|---|---|---|---|
| 1-138980 | 9/1989 | Japan | E03D 11/02 |
| 2-35134 | 2/1990 | Japan | E03D 11/02 |
| 2-35135 | 2/1990 | Japan | E03D 11/02 |
| 3-40380 | 4/1991 | Japan . | |
| 4-32178 | 5/1992 | Japan . | |
| 5-83077 | 11/1993 | Japan | E03D 5/012 |
| 7-54388 | 2/1995 | Japan | E03D 11/02 |

OTHER PUBLICATIONS

International Search Report (attached) dated Mar. 26, 1996.

*Primary Examiner*—David J. Walczak

*Attorney, Agent, or Firm*—Michael D. Bednarek; Crowell & Moring LLP

[57] ABSTRACT

A flush toilet bowl comprises a bowl part (1) and a discharge trap (2) formed continuously at the bottom of the bowl part, and the discharge trap (2) further comprises a rising channel (22) extending in the obliquely upward direction from the bottom of the bowl part, a first weir (27) formed at the upper end of the rising channel, a descending channel (23) extending downwardly from the first weir, and a cross-laid channel (24) extending substantially in the horizontal direction from the lower end of the descending channel and having a discharge opening (25) at the end. The cross-laid channel (24) is provided with an upwardly bent second weir (28) between the lower end of the descending channel and the discharge opening, and a gathered water part (29) is formed between the second weir (28) and the lower end of the descending channel and, simultaneously, the descending channel is formed in the vicinity of the lower end thereof with a horizontal part (26) extending horizontally toward the cross-laid channel (24).

36 Claims, 22 Drawing Sheets

| | PRESENT EMBODIMENT | COMPARISON EXAMPLE 1 | COMPARISON EXAMPLE 2 |
|---|---|---|---|
| PLAN VIEW (PRINCIPLE VIEW) | RIM FLUSHING WATER IS TURNED TO THE RIGHT 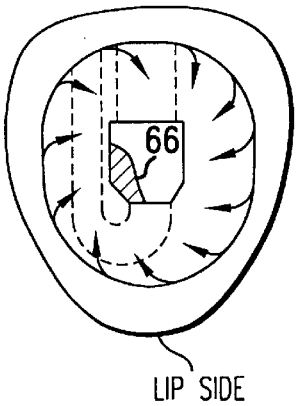  | RIM FLUSHING WATER IS TURNED TO THE RIGHT 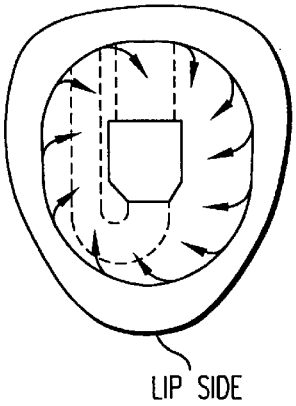  | RIM FLUSHING WATER IS TURNED TO THE RIGHT 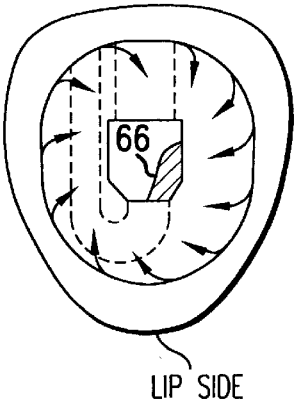  |
| NOISE dB (A) 69– 68– 67– 66– 65– 64– | 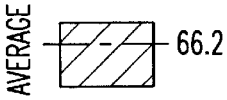  | 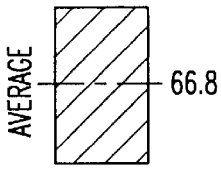  | 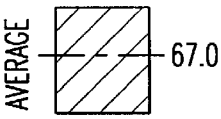  |
| VALUA-TION | GOOD | POOR | VERY POOR |
| CONSIDERATION | DISTRIBUTION OF THE VELOCITY OF FLOW 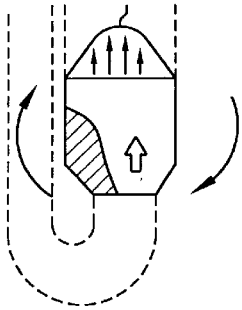 | DISTRIBUTION OF THE VELOCITY OF FLOW 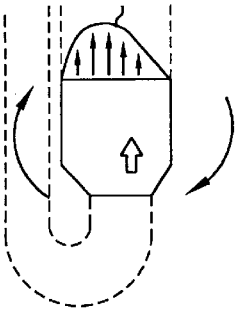 | DISTRIBUTION OF THE VELOCITY OF FLOW 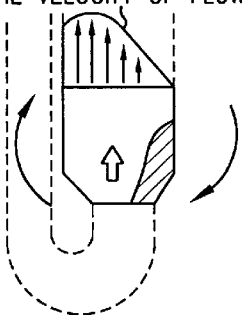 |

FIG. 24

HIGH PERFORMANCE FLUSH TOILET

RELATED APPLICATIONS

This application is a continuation-in-part of U.S. application Ser. No. 08/860,419 which is the national stage application corresponding to International Application PCT/JP95/02722 filed Dec. 27, 1995, which application is currently pending.

BACKGROUND OF THE INVENTION (1) Field of the Invention

The present invention relates to a flush toilet bowl, and more particularly to a toilet bowl of the type in which water is supplied by gravity and sewage is discharged by a siphoning action.

(2) Background

In response to the need to conserve water, governments everywhere have looked for ways to reduce the amount of water used by the customers of municipal water companies. Toilets have long been identified as major users of water. It is not surprising therefore that many municipal programs and new laws have focused on reducing water used by toilets.

Before the 1950s, toilets typically used 7 gallons or more for each flush. By the end of the 1960s, toilets were designed to flush with only 5.5 gallons, and in the 1980s the new toilets being installed were using only 3.5 gallons. Beginning in the 1980's some states passed laws requiring that toilets use no more than 1.6 gallons (6 liters) per flush. In 1995 the National Energy Policy Act (H.R. 776) went into effect and mandated 1.6-gallon toilets for the entire U.S. Thus, new toilets must flush only 1.6 gallons (6 liters) of water, less than half the amount they used in the '80s. This limitation has now been extended to include commercial toilets as well as residential toilets.

In an effort to meet these requirements and to conserve water, there has been a trend toward toilet bowl designs that achieve adequate flushing while minimizing the use of water. However, as less and less water was available, efforts have shifted to complete redesign of the toilet. There have been two basic approaches: the gravity-flush siphon toilet—water stored in a tank drains from the tank to force waste down the drain by a siphoning action—and the pressure-assisted toilet. Toilets that pressurize the flush water generally perform better than conventional gravity-flush models but are noisier and usually more expensive. One example of a jet flush water supply system for a toilet stool is disclosed in U.S. Pat. No. 5,502,845 to Hayashi et al. This patent discloses a flush toilet stool that includes a toilet bowl and a trap drainage passage connected to the toilet bowl. The toilet bowl has a water jet hole defined in a bottom region thereof and opening toward the trap drainage passage. A water pump or similar pressurizing unit is coupled to the water jet hole for drawing water under lower pressure directly from an external water supply and expelling the water under higher pressure through the water jet hole toward the trap drainage passage to develop a siphon flow to discharge sewage from the toilet bowl through the trap drainage passage.

The problem with power-assisted toilets is that they are complex, expensive and loud. As a result, such assemblies do not find favor of consumers and are often difficult if not impossible for homeowners to repair.

Other attempts to use mechanical assistance for the flushing action suffer similar drawbacks. Briggs Industries, Inc. has, for example, introduced a pressure-assisted toilet that uses a new design configuration for both the tank and bowl. This newly designed system, called the Vacuity, creates a vacuum that further assists the flushing action of the toilet. This toilet is said to feature a larger water surface area in the bowl with a more efficient flush, plus the flush is a much less noisy than other pressure-assisted low-flow toilets on the market and perhaps less noisy than an old-fashioned conventional gravity-flush toilet. Again, however, this product is complex and its performance is not believed to be adequate.

For these reasons, low-flow toilets are still not well-accepted by many consumers, notwithstanding improvements in design and operation. Achieving an adequate flush with such limited use of water has proved to be a great challenge.

Thus, there remains a need for an improved flush-type toilet bowl of the type that discharges sewage by a siphoning action that is more simple, less expensive, provides better performance and is more silent than know high-performance toilets. There are, of course, a wide variety of siphon-type toilet stool constructions known. A typical siphon-type toilet is described in JP-U Sho-58-25381. The flush toilet bowl described in this publication is called the siphon jet type, and the water discharge trap of the toilet bowl has a stepped part in a descending path and is transversely bent substantially at a right angle on the downstream side of the stepped part and, thereafter, a discharge opening opens vertically (hereinafter, such a discharge trap is referred to as cross-laid type trap).

In this type of flush toilet bowl, the stepped part provided in the descending channel of the discharge trap causes a disturbance of water flow and forms the wall of water (seal), thereby producing a siphoning action, according to the principle of siphoning action. More specifically, before flushing, the interior of the discharge trap is under an atmospheric pressure which is the same as that on the surface of the gathered water. The supplying of flushing water to this place causes the disturbance of water flow due to the stepped part, thereby forming a wall of water (seal) which closes one end of the trap.

When the supply of water continues in a condition of the seal being formed, air within the trap is discharged together with water and the pressure within the trap becomes negative with respect to the atmospheric pressure. This negative pressure causes a drawing force. As the discharge of air further proceeds, the trap is substantially filled with water and, at this time, the maximum drawing force occurs. In particular, the siphoning action produced by the initial seal, grows by the discharge of air and puts forth the maximum drawing force when the trap is filled with water. Thus, it is recognized that the rapid production and growth of the siphoning action is important in order to save the amount of the flushing water.

Particularly, in the case where the position of the flush tank in the flush toilet bowl is attempted to be lowered for low-silhouetting the bowl, the potential energy of flushing water naturally becomes smaller, and so, in order to save an amount of flushing water, the realization of the above-described rapid production and growth of the siphon is all the more important and, moreover, ensuring a high capacity of water discharge is required.

U.S. Pat. No. 5,142,712 discloses a toilet bowl having a construction that causes air within the discharge trap to be discharged early to ensure the early production of the siphon. The toilet bowl is provided with a cross-laid type discharge trap in a similar way to the toilet bowl disclosed in the above-described JP-IT 58-25381. The crosslaid channel is bent upwardly before the discharge opening to provide a gathered water part before the discharge opening, in which a seal part is constituted. The air existing between the sealed water part and the above described gathered water part is drawn under a negative pressure produced within the sealed tank by the discharge of the water within the sealed tank, so that the air within the trap is discharged, thereby ensuring the early production of the siphoning action. In this connection, the reason why a ventilation space is provided in the gathered water part in such a toilet bowl, is that there occurs the following disadvantage: if there is no ventilation room, siphoning occurs very easily because of the seal being always constituted at two points. For example, in the case where a negative pressure occurs in the discharge pipe, such negative pressure sucks and discharges not only the water in the gathered water part, but also the sealed water per se in the toilet bowl, so that odor from the discharge pipe reversely flows into the chamber by way of the bowl part of the toilet bowl.

However, the toilet bowl described in said U.S. Pat. No. 5,142,712 requires a sealed tank construction because of the utilization of the negative pressure within the tank. Further, connection of the downstream of the sealed the interior of the tank produces the possibility of odor flowing into the tank, and so a separate construction on for preventing such a possibility is required.

Accordingly, as to the construction of a toilet bowl, it is believed that the toilet bowl disclosed in U.S. Pat. No. 5,142,712 is conventionally used in combination with an ordinary tank which has no sealed construction and has only a function of gathering and discharging water; however, there occur problems as described below.

Since the sealed part is constituted only by the gathered water part, a large amount of water is required to close the above-described ventilation room, and it takes much time to produce a siphoning action; consequently, a large amount of flushing water is required. Making this ventilation room narrower is considered, however, there is a problem in that if it is made too narrow, the above described disadvantages are apt to occur.

Further, an air pool is apt to occur in the inner portion of the descending channel of the trap and hinders the growth of a siphoning action, so, it is difficult to expect a sufficient effect in terms of the early production of a siphoning action in spite of the adoption of the sealed construction due to the gathered water part.

Moreover, since the weir between the rising channel of the discharge trap and the descending channel of the discharge trap is bent substantially at a right angle, the water which has passed through the weir comes off the weir and collides with the side wall at the back of the descending channel of the trap before it reaches the gathered water part, thereby forming water turbulence which swallows up the air within the trap. Further, it takes much time to discharge the air within the trap.

In addition, there was a problem in that in the crosslaid type of trap, water stream changes from the transverse direction to the vertical direction before the discharge opening in view of its construction; however, a change of direction of the water stream at this portion is not smoothly performed and a force of water discharge from the discharge opening is reduced.

Further, it is empirically known that the thinner the diameter of the discharge trap is, the earlier the production of the siphoning action is, however, if the diameter of the trap is made too thin, clogging of sewage is apt to occur and the primary function of the toilet bowl is adversely affected. Moreover, a large change in the diameter of the discharge trap causes a large loss of energy, so, when the siphoning action is produced, a force of suction due to the siphoning action does not become great, and an increase in the flushing capacity cannot be so expected.

In regard to another type of flush toilet bowl, a low-silhouette type of flush toilet bowl having a flush tank, in which flushing water is stored, disposed in a position lower than the toilet bowl body, is generally regarded as a high grade flush toilet bowl. Such a type of flush toilet bowl in the past includes the one which is described in JP-A Sho-64-75740. The toilet bowl described in this publication is a toilet bowl of a so-called siphon vortex type in which a siphoning action and a vertical action are used in combination. A decrease in the force of water supplied to the tank due to the fact that the position of the top of the flush tank B is lowered, as shown in FIG. 27, to suppress the water level of the flushing water from a rim surface 3*a* of the toilet bowl body A in a lower level, is supplemented in such a way that the flush tank B is positioned lower than the rim surface 3*a* to thereby increase the capacity of the tank to make an amount of water used at the time of flushing larger; thereby ensuring a total amount of discharge of 16 liters or so (total amount discharged from the toilet bowl to the discharge pipe in a single usage).

As noted above, however, the requirement of water saving for the flush toilet bowl has become very strict, especially, in the U.S. The total amount of discharge is now limited to 1.6 gallons (6 liters). Therefore, it is difficult to save water while ensuring the flushing capacity using the siphon-type toilet bowl having a conventional construction, and it is particularly difficult to cope with such a requirement with the low-silhouette type toilet bowl.

The present invention has been made taking the above described problems in the prior art into consideration and aims at providing a flush toilet bowl which can sufficiently cope with the strict requirements of water saving in recent years and allows sufficient flushing capacity to be displayed.

SUMMARY OF THE INVENTION

The present invention provides a gravity flush toilet bowl that is more simple, less expensive, provides better performance and is more silent than pressure-assisted toilet bowls. These desirable features are a result of a combination of various design features, most notably an improved trap design, an improved quick shut-off valve assembly and a design for increasing the pressure of the flushing water by increasing the height (pressure head) at which the water for flushing is taken.

More specifically, the present inventors have found that prior art trap design wastes a large portion of the energy of the flush because of the flush because of the shape and flow ratio and velocity of the drain trap designs. These drain trap designs are, however, necessary as part of the basic siphoning structure that is used in conventional toilets.

Another known problem with typical constructions is "double siphoning" caused by the shape of the trap. The ratio of distribution of water volume from rim to jet and other known problems can also contribute to performance.

To achieve improved performance, therefore, the inventors recognize that there is a need to maximize water power by reducing friction between water and the surface of the trap walls. One object of the present invention is to redesign the shape of the trap to minimize frictional power losses. This entails, among other things, a larger trap dimension.

This is made possible by virtue of a new siphoning method that ensures improved dimensioning.

Moreover, to facilitate water flow, the drain trap of the present invention provides a water pooling section that is designed to retain a small amount of water to optimize flow of the water through the drain pipe.

In addition, to increase flow rate, the present inventors have designed a improved valve assembly that closes before the tank is fully discharged allowing use of a taller tank so as to get improved pressure head.

In general, therefore, the improvements of the present invention can be described in connection with the tank side and in connection with the bowl side of the typical toilet bowl. With regard to the tank side, the present inventors have found that providing a bigger discharge port and taller water tank yield improved flushing. In connection with this finding, and relating to the bowl side, the inventors have found that a combination of a rim-flush, jet-flush and trap-way siphon provides maximum flushing.

More specifically, the present invention provides a flush toilet bowl that includes a toilet bowl body having a bowl part and a discharge trap extending from a location proximate the bottom of the bowl part. The bowl part has a rim portion that has an upper rim surface. A flush water tank is disposed at the back of the toilet bowl body. The flush water tank includes a discharge port that opens into the flush water tank at a predetermined level. The flush water tank contains a first predetermined volume of water that is located above the level of the discharge port and adapted to be discharged through the discharge port.

A valve assembly is provided for sealing the discharge port so as to prevent the discharge of flush water from the tank. The valve assembly includes a valve body that is movable between a closed position wherein the valve body blocks the discharge opening so as to prevent the discharge of flush water from the tank and an open position wherein the valve body is spaced from the discharge port so that flush water may be discharged from the tank through the discharge port. The valve assembly also includes a force transmitting member for allowing a user to move the valve body from the closed position to the open position to initiate flushing. The valve assembly is designed to allow the valve body to return to the closed position, preferably upon release of the force transmitting member by the user, so as to prevent the discharge of flush water from the tank before the entire first predetermined volume of water that is located above the level of the discharge port is discharged through the discharge port whereby only a second predetermined volume of water, which is less than the first predetermined volume of water, is discharged through the discharge port. In this way, the difference between first predetermined volume of water that is located above the level of the discharge port and the second predetermined volume of water, which is actually discharged through the discharge port is a third volume of water that is used to pressurize the water that is actually discharged.

Preferably the first predetermined volume of water that is located above the level of the discharge port and adapted to be discharged through the discharge port is greater than 6 liters and the second predetermined volume of water is 6 liters or less so that the toilet meets water conservation requirements while taking advantage of the excess pressure provided by the additional water, i.e., the third predetermined volume.

A water passage connects the discharge port to the toilet bowl. The water passage preferably includes a jet water path that connects the discharge port of said flush water tank to a jet water delivery port provided facing the inlet of said discharge trap. The jet water path preferably includes a bent part turning the direction of flow toward the jet water delivery port before the jet water delivery port. The jet water delivery port is preferably provided in the vicinity thereof with a means for revising a distribution of the velocity of flow. The means performing the revision of the distribution of the velocity of flow is designed such that the velocity of flow substantially in the center of the jet water delivery port becomes the maximum. The means for revising the distribution of the velocity of flow may be of a construction of the axis of said jet water delivery port being offset to the inner peripheral side of said bent part. The means for revising the distribution of the velocity of flow may comprise an inclined surface formed by tilting the bottom of the bent part of the jet water path toward the inner peripheral side. The bent part of the jet water path preferably has a radius of curvature of 20 to 30 mm and a cross-sectional area which amounts to 0.3 to 0.6 times the cross-sectional area of the discharge trap.

Further, the present invention provides a flush toilet bowl according to the present invention comprises:

a bowl part, and a discharge trap formed continuously at the bottom of said bowl part, said discharge trap including a rising channel extending in the obliquely upward direction from the bottom of the bowl part; a first weir formed at the upper end of said rising channel; a descending channel extending downwardly from said first weir; and a cross-laid channel extending substantially horizontally from the lower end of said descending channel and having a discharge opening at the end thereof, said cross-laid channel being provided with an upwardly bent second weir between the lower end of said descending channel and the discharge opening, and being formed with a gathered water part between said second weir and the lower end of said descending channel, said descending channel being formed in the vicinity of the lower end thereof with a horizontal part extending horizontally toward said cross-laid channel.

Further, a flush toilet bowl according to the present invention comprises:

a toilet bowl body having a bowl part and a discharge trap formed continuously at the bottom of said bowl part;

a flush water tank disposed at the back of said toilet bowl body so that its discharge port is positioned substantially at the same level as the rim surface of the toilet bowl body: and a jet water path which connects the discharge port of said flush water tank to the jet water delivery port provided facing the inlet of said discharge trap, said jet water path having a bent part turning the direction of flow toward the Jet water delivery port before the jet water delivery port, and said Jet water delivery port being provided in the vicinity thereof with a means for revising a distribution of the velocity of flow, said means performing the revision of a distribution of the velocity of flow so that the velocity of flow substantially in the center of the jet water delivery port becomes the maximum.

Moreover, a flush toilet bowl according to the invention, comprises:

a toilet bowl body having a bowl part and a discharge trap formed continuously at the bottom of said bowl part:

a flush water tank disposed at the back of said closet bowl body so that its discharge port is positioned substantially at the same level as the rim surface of the toilet bowl body; and a jet water path which connects the discharge port of said flush water tank to the jet water delivery port provided facing the inlet of said discharge trap, said jet water path being provided with an air discharging means by which the air within said jet water path is discharged substantially at the same time a discharge of water from the discharge port of said flush water tank is started.

According to the invention, the uneven distribution of the velocity of flow, which occurs at the point where the direction of the flow of flushing water is changed from the descending channel to the cross-laid channel of the discharge trap, is revise d by the horizontal part, the production And maintenance of the seal of the discharge trap due to the flushing water are ensured, thereby enabling the realization of the stabilization of the production of a siphoning action and the rapid growth thereof.

Further, according to the invention, since a radius of curvature of the weir between the rising channel and descending channel of the discharge trap is made into a large radius of curvature which amounts to 0.9 to 1.4 times the size of the diameter of the discharge trap, a change of direction as the flow of flushing water changes from the transverse direction to the vertical direction, while flowing from the rising channel to the descending channel of the discharge trap, is made smooth to prevent water from coming off the weir, thereby ensuring a large force of water discharge and, simultaneously, allowing flushing water to be supplied to the gathered water part without any loss, so that the early production and rapid growth of a siphoning action can be realized.

Moreover, according to the invention, since after the cross-laid channel is bent upwardly to form the gathered water part, it is formed so as to continue from its bent part to the discharge opening and, further, the downward portion of the bent part has a large radius of curvature of 0 7 to 1.2 times the size of the diameter of the trap, a change of direction as the flow of flushing water changes transverse direction to the vertical direction before the discharge opening of the discharge trap is made smooth to prevent water from coming off the bent part, thereby enabling a large force of water discharge to be ensured.

In addition, according to the invention, since the means for revising a distribution of the velocity of flow is provided near the jet water delivery port so that the velocity of flow substantially in the center of the jet water delivery port becomes the maximum, even if sewage exists in any position near the jet water delivery port, the velocity of flow sufficient to cause the siphoning action to be produced can be obtained.

Besides, according to the invention, the air discharging means provided in the jet water path allows the air within the jet water path to be rapidly discharged, thereby bringing about the effective action of the head (water head) of the flushing water tank.

The present invention also provides a process for improving flushing performance while using a predetermined volume of water. The process comprising the steps of: supporting the predetermined volume of water in a the flush water tank with additional water above the level of the discharge port so that the total volume of water contained above the level of the discharge port in the tank is greater than the predetermined volume; moving the valve body from the closed position to the open position to initiate flushing so as to discharge the predetermined volume of water through the discharge port; and returning the valve body to the closed position so as to prevent the discharge of flush water from the tank before additional water located above the level of the discharge port is discharged through the discharge port. By virtue of this process only the predetermined volume of water, which is less than the total volume of water above the level of the discharge port, is discharged through the discharge port so that the difference between the volume of water that is located above the level of the discharge port and the predetermined volume of water, which is actually discharged through the discharge port is used to pressurize the water that is actually discharged.

The process of the present invention can also include the steps of guiding water through a jet water path that extends from the discharge port to the a jet water delivery port provided facing the inlet of said discharge trap, wherein the jet water path has a bent part turning the direction of flow toward the jet water delivery port before the jet water delivery port; and revising the distribution of the velocity of flow so that the velocity of flow substantially in the center of the jet water delivery port becomes the maximum.

BRIEF EXPLANATION OF THE DRAWINGS

FIG. 24 is a diagram for comparison of the embodiment according to the invention with a comparison example.

DETAILED DESCRIPTION

Figure 1:
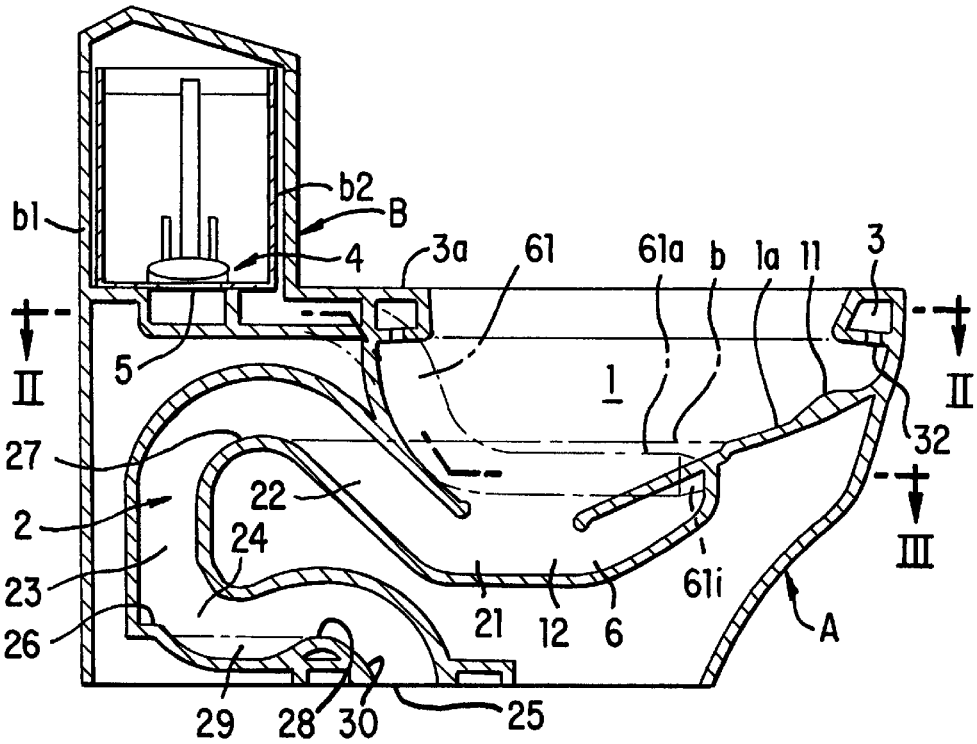
FIG. 1 is a central longitudinal sectional view showing an embodiment of a flush toilet bowl according to the present invention.

An embodiment of the invention will now be described with reference to FIGS. 1 to 5. In the drawings, A indicates a toilet bowl body comprising a bowl part 1 and a discharge trap 2. The bowl part 1 is provided on the upper peripheral edge thereof with a water passing rim 3. Further, reference character B indicates a flush tank in which flushing water is stored. As shown, the flush tank is integrally formed with the toilet bowl body A at the back of the toilet bowl body A. If desired, a separate tank could be used or the toilet bowl could be used without a separate tank as is common in commercial applications.

The flush water tank B in the illustrated embodiment comprises an outer tank b1 integrally formed with the toilet bowl body A and an inner tank b2 made of a synthetic resin-molded part. The inner tank b2 is housed and arranged within the outer tank b1. When the inner tank b2 is filled with water the water level is adapted to reach a value significantly in excess of 120 mm. The water level is determined by the height of the overflow tube. However, the volume of water in the lowest 100–120 mm of the water corresponds to the amount of water that is actually used during flushing. The remaining water is used to increase the pressure head of the water as explained below.

Figure 1A:
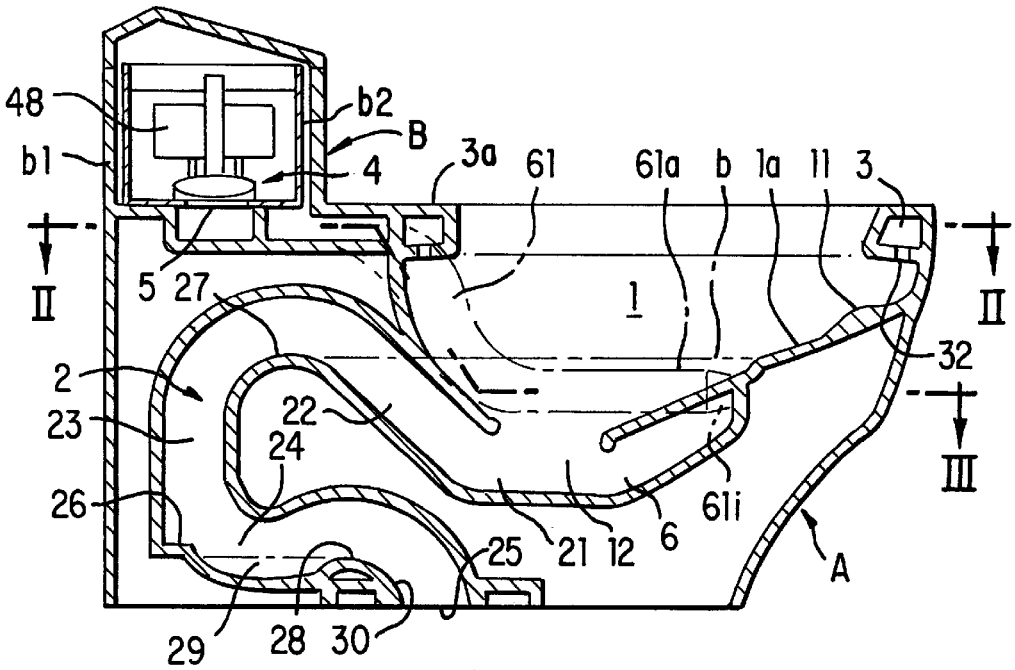
FIG. 1A is a central longitudinal sectional view showing another embodiment of a flush toilet bowl according to the present invention.

FIG. 1A shows another form of toilet bowl. The toilet bowl is similar to that of FIG. 1, with several significant exceptions. In particular, the embodiment of FIG. 1A has a shorter tank, which is preferred in a low silhouette toilet. When the inner tank b2 is filled with water, the water level is adapted to reach a value of 100 mm to 120 mm. The precise water level is determined by the height of the overflow tube 43.

The advantage of the design shown in FIG. 1 as compared to the design shown in FIG. 1A is that the water that is used for flushing has a higher head than the water that is used for flushing in the embodiment of FIG. 1A.

The embodiment of FIG. 1A also includes a counter balance 48 which assists in timing the return of the valve body 44 to a closed position with respect to the valve seat 42. The embodiment of FIG. 1, on the other hand, does not include a counter balance so that the valve body will return to a closed position more quickly once the handle or other operating mechanism is released.

The significance of these differences will be described below

Aside from these differences, the bowl constructions are similar and will be described jointly hereinafter.

In both embodiments, the bottom surface of the inner tank b2 of the flush water tank B is positioned at the same height as the rim surface 3*a* of the toilet bowl body, i.e., the upper surface of the water passing rim 3, and is provided with a discharge port 5 adapted to be closed and opened by a discharge valve 4.

Figure 5:
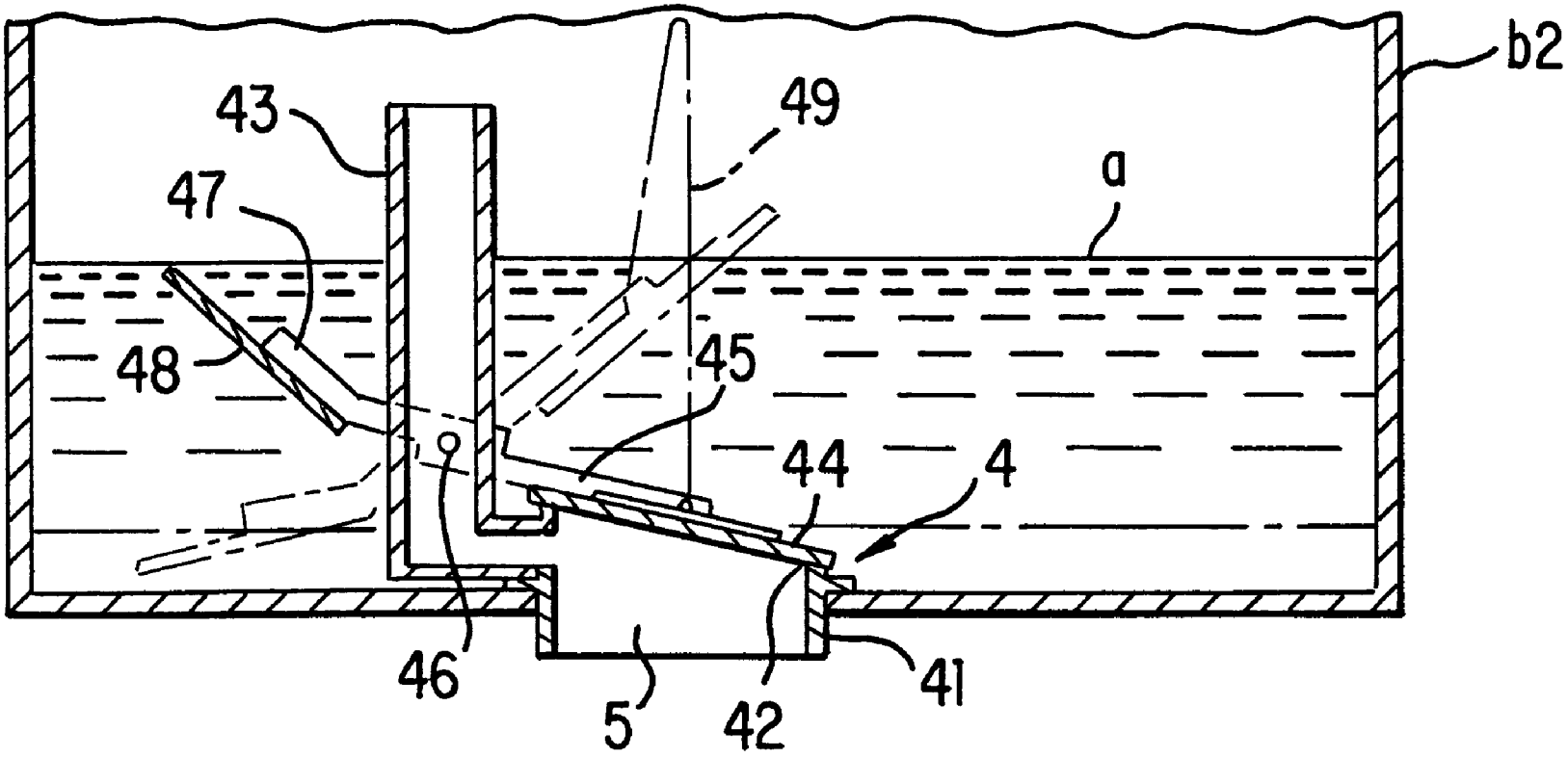
FIG. 5 is an enlarged sectional view of a portion of a flush water tank and shows a closed valve situation of a discharge valve in full line and a opened valve situation thereof in two-dots chain line.

The above-described discharge port 5 is basically constituted by a cylindrical discharge valve body 41 provided at the bottom of the flush water tank B so as to penetrate the bottom, as shown in FIG. 5. According to one important aspect of the present invention, the inner diameter of the valve body is preferable in the range of 70 mm to 75 mm. In contrast, the inner diameter of the discharge port of a conventional general flush tank is generally about 50 mm. As a consequence, the flow capacity of the valve body is about twice that of a conventional flush tank.

The above-described discharge valve body 41 constituting the discharge port 5 has an upper end extending and opening into the inner tank b2 and cut obliquely, the opening edge of which constitutes a valve seat 42 for the discharge valve 4. Further, the discharge valve body 41 is provided with an overflow tube 43 which rises from the lateral side of the discharge valve body and communicates at the lower end thereof with the discharge port 5. This overflow tube 43 also serves as a support for a valve body 44 and the valve body 44 corresponding to the above-described valve seat 42 is pivotably connected to the base of the overflow tube 43.

The valve body 44 is of a disc shape and is provided on the upper surface thereof with a pair of support arms 45 extending parallel to said upper surface. The support arms 45, 45 are pivotably connected to the overflow tube 43 at a shaft 46 with the overflow tube 43 held between the arms.

Accordingly, the valve body 44 is pivotally movable with the pivotably supported part of the arms 45 in the vertical direction such that upward pivotal motion causes the valve body 44 to be moved away from the valve seat 42, thereby opening the discharge valve 4 which in turn opens the discharge port 5, and the downward pivotal motion from such an opened valve situation causes the valve body 44 to rest on the valve seat 42, thereby closing the discharge 15 valve 4 which in turn closes the discharge port 5.

On the upper surface of the valve body 44 in the center thereof is connected an operating force-transmitting member 49 such as a chain to transmit the operating force of an operating means (a flush lever or pull not shown) provided on the side wall of the tank body B to allow a user to move the valve body from the closed position to the open position to initiate flushing. Operation of the operating member causes the valve body 44 to be pulled up and pivotally moved in the upward direction so that the discharge valve 4 can be opened. Thus, the present invention provides a valve assembly for sealing the discharge port so as to prevent the discharge of flush water from the tank that includes a valve body 44 that is movable between a closed position wherein the valve body blocks the discharge opening 5 so as to prevent the discharge of flush water from the tank and an open position wherein the valve body is spaced from the discharge port 5 so that flush water may be discharged from the tank through the discharge port. The valve assembly is designed to allow the valve body to return to the closed position, preferably upon release of the operating mechanism of the force transmitting member by the user.

In the embodiment of FIG. 1A, a counter balance 48 is secured to the end 47 of the arms 45 that is opposite the valve body. The counter balance 48 helps control the timing of the closing of the valve 4 so that the desired amount of water (typically 6 liters) is released. In the embodiment of FIG. 1, on the other hand, there is more than 6 liters of water available for flushing and the water has a higher pressure head. Thus, it is important to quickly close the valve before all of the water is released. The present inventors have found that this can be achieved by removing the counter balance 48 so that the valve seat quickly returns to the closed position.

Because of the high pressure head (resulting from the increased height of the water in the tank) and the size of the valve opening (about twice that of conventional toilets) the entire 6 liters of water is released in a quick high pressure burst. In this way, the quick closing of the valve seat 44 allows use of the extra water to pressurize the water that is actually used for flushing.

More specifically, in the embodiment of FIG. 1, the flush water tank contains a first predetermined volume of water (determined by the height of the overflow tube 13) that is located above the level of the discharge port and adapted to be discharged through the discharge port. In this embodiment, the valve assembly is designed to allow the valve body to return to the closed position upon release of the operating mechanism of the force transmitting member by the user so as to prevent the discharge of flush water from the tank before the entire first predetermined volume of water that is located above the level of the discharge port is discharged through the discharge port. Thus, only a second predetermined volume of water, which is less than the first predetermined volume of water, is discharged through the discharge port. In the embodiment shown, this second predetermined volume (preferably 6 liters or less) corresponds to the volume of water in the lowest 100 mm to 120 mm of the tank. In this way, the difference between first predetermined volume of water that is located above the level of the discharge port and the second predetermined volume of water, which is actually discharged through the discharge port is a third volume of water that is used to pressurize the water that is actually discharged.

Preferably the first predetermined volume of water that is located above the level of the discharge port and adapted to be discharged through the discharge port is greater than 6 liters and the second predetermined volume of water is 6 liters or less so that the toilet meets water conservation requirements while taking advantage of the excess pressure provided by the additional water, i.e., the third predetermined volume.

In the meantime, the water passing rim 3 of the toilet bowl body A is formed so that it extends to the interior of the bowl part 1 over the entire periphery of the upper end of the bowl part 1. The bottom face of the rim is formed so that it faces the interior of the bowl part 1. The water passing rim 3 is connected with the discharge port 5 of the flush water tank B by way of the rim water path 31. The discharge port 5 is located on the center line which divides the toilet bowl body A into the two right and left parts.

Figure 2:
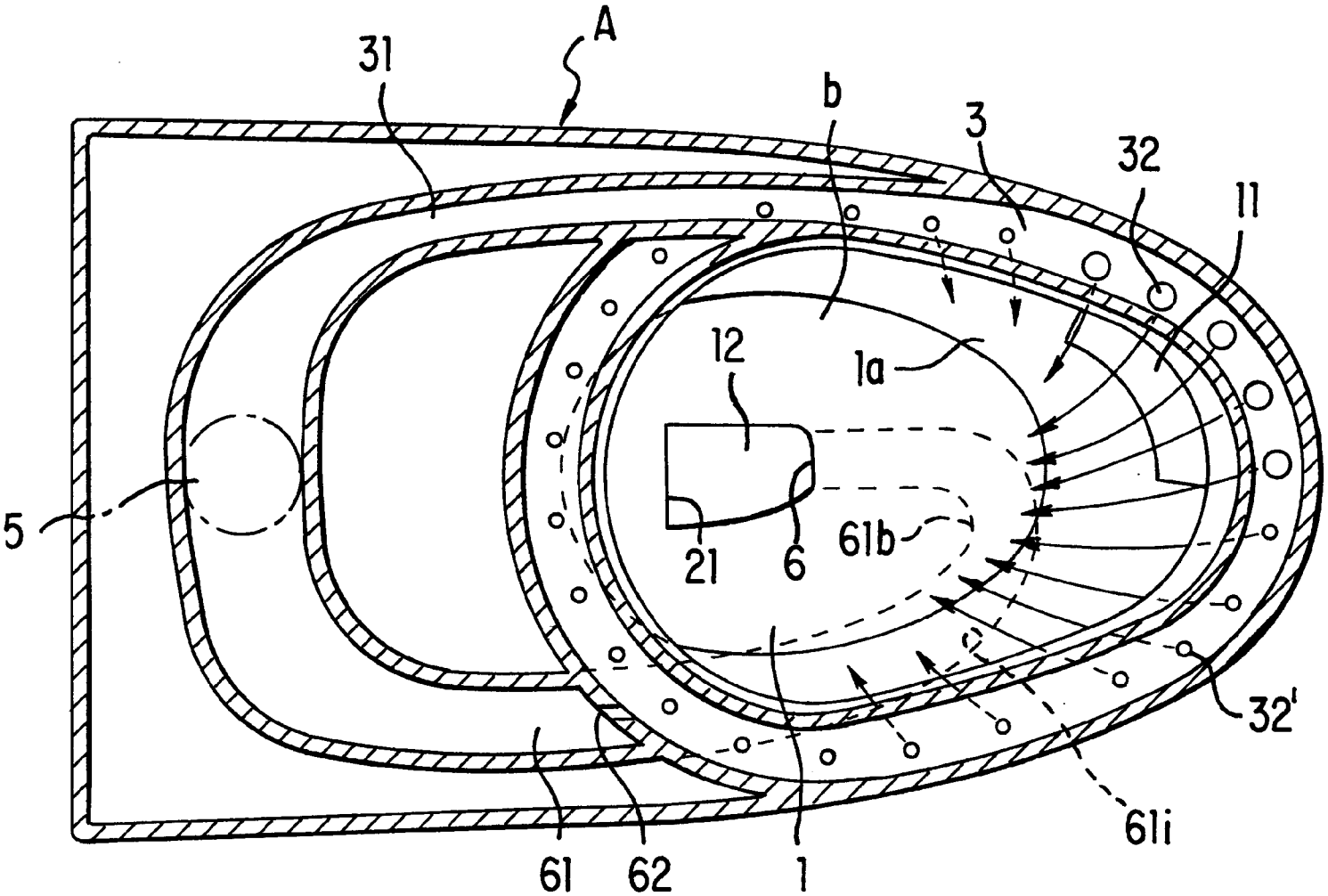
FIG. 2 is a sectional view taken along line II—II in FIG. 1.
Figure 3:
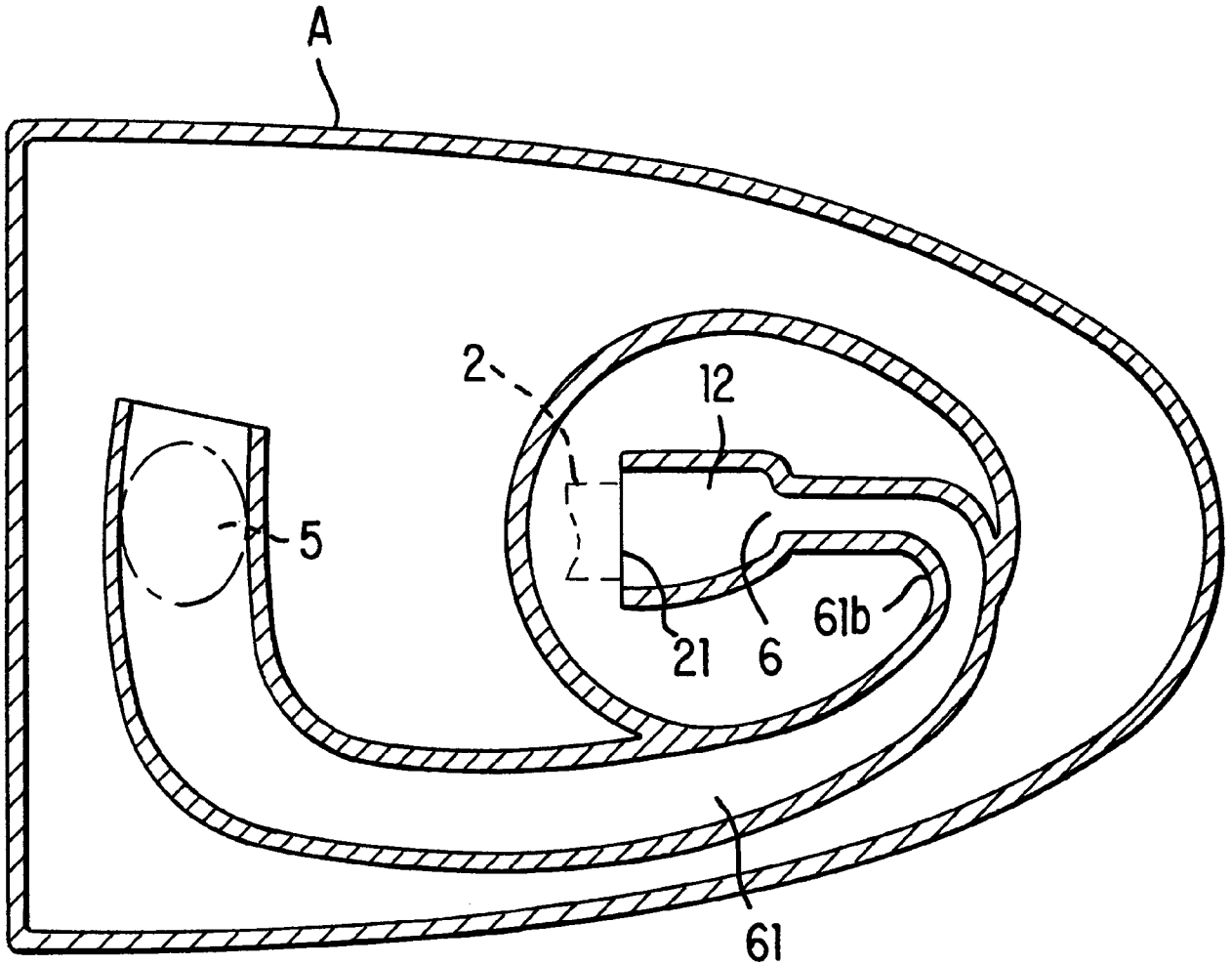
FIG. 3 is a sectional view taken along line III—III in FIG. 1.
Figure 4:
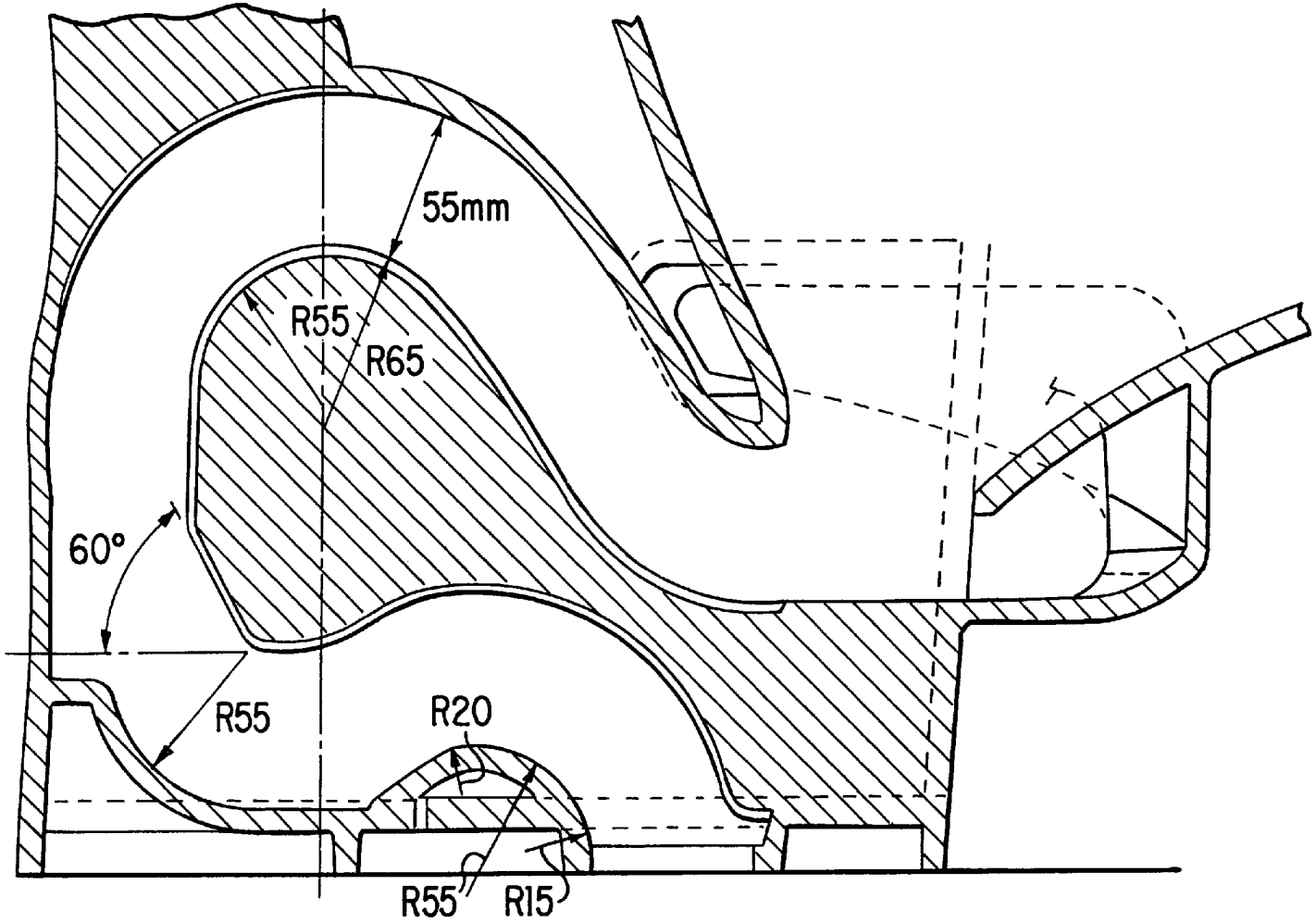
FIG. 4 is an enlarged longitudinal sectional view showing the detail of a discharge trap.

As shown in FIG. 2, the rim water path 31 is formed so that it is distributed to the right, while to the left is a jet water path 61, which will be described later, is formed to the left of the center line that divides the toilet bowl body A into the two right and left parts, as shown in FIG. 2. The rim water path 31 communicates with the rim 3.

The above-described water passing rim 3 is provided at the bottom thereof with rim water outlet holes 32, 32' over the entire periphery. The rim water outlet holes 32 positioned near the front end of the toilet bowl each have a diameter that is larger than the other rim water outlet holes 32'. Further, the holes 32 with the larger diameter are inclined toward the left or the right. In the illustrated embodiment, the holes 32 are inclined toward the left of the toilet bowl body A. By virtue of this design, flushing water, which flows from the discharge port 5 of the flush water tank B into the water passing rim 3 by way of the rim water path 31, flows out of the rim water outlet holes 32, 32' and is supplied into the bowl part 1 along the bowl surface 1*a,* includes a rotating main flow (in this case, to the right) which is formed by the water flowing out of the rim water outlet holes 32 with larger diameters provided near the front end of the above-described toilet bowl.

This main flow has a function of revising a distribution of the velocity of flow from a jet water discharge port which will be described later.

The bowl part 1 includes a horizontal portion 11 that is located below the above-described rim water outlet holes 32 having large diameters. The existence of this horizontal portion 11 prevents water from being gathered in the direction of stopping the above-described rotation and maintains the good rotation, even if a force of the supplied flushing water is reduced and the direction of the water delivered from the rim changes, and thus efficiently functions for the effective discharge of sewage and the improvement of the flushing property of the bowl surface.

Moreover, the bowl part 1 forms a sewage dropping recess 12 at the bottom thereof, which provided at the back wall portion thereof with an inlet 21 of the discharge trap 2 and at the front wall portion with jet delivery port 6 facing the above-described discharge trap inlet 21.

This jet delivery port 6 is separately provided independently of the rim water path 31 and water passing rim 3 and communicates with the above-described discharge port 5 by way of a jet water path 61 that is extends to the left, while to right is the rim water path 31, with respect to the center line, that divides the toilet bowl body A into the right and left parts.

Accordingly, the flushing water, which is supplied from the flush water tank B to the toilet bowl A, is divided into two parts. The first part of the flush water flows through the rim water path 31 and water passing rim 3 and is supplied to the bowl part 1 from the rim water outlet holes 32, 32', as described above. The second part of the flush water flows through the jet water path 61 and is discharged directly toward the discharge trap inlet 21 from the jet delivery. By virtue of this construction, a large amount of water is fed into the discharge trap 2 at a time and, simultaneously, sewage is strongly pressed into the discharge trap 2.

Increasing the amount of a water delivered (delivery ratio) at the jet side is preferable for the production of a siphon, but flushing water must be provided at the rim side to some degree to form the rotating flow within the bowl part 1 and ensure adequate flushing of the bowl. Taking the property of water saving into consideration, in the case where, for example, 6 liters of water is flushed, the distribution of flushing water is preferably in a range of rim side: jet side=1:4 to rim side: jet side=2:3.

The jet water path 61 will now be described. In general, a siphon-type toilet bowl having a jet water path 61 waits in an unused state with air gathered in a portion of the water path 61. When water is discharged out of the flush water tank B, it flows through the jet water path 61 while discharging such air.

At this time, jet water from the tank is most strongly drawn out when the jet water path 61 is filled with water. In other words, since in the state where air remains within the jet water guide 61, the air becomes an obstacle and the jet water cannot be sufficiently ensured and the tank head cannot be effectively utilized. Accordingly, it is very important that the air within the water path or guide be discharged quickly.

Various alternatives have been considered for extracting air from the jet water guide 61. These include methods which extract air from the jet delivery port 6, methods of installing an air extracting hole inside the water path 61 (preferably, at the upper portion of the water path 61) and the like. Because pressing air out entails a loss of energy, the former method is accompanied by energy loss, and so the latter method is preferable.

However, assuming that an air extracting hole is provided at the upper portion of the jet water path 61, in the case where the jet water path 61 is obliquely connected to the discharge port 5 and jet water delivery port 6 (the conventional toilet bowls with jet water paths mostly being of such construction), water flows rapidly down through the jet water path 61. However, since the water flows along the bottom of the water path 61, the air within the water path 61 is merely pulled and extended by the water which flows down, without being discharged. Thus, when the force of water becomes weak, the air grows into lumps and blocks the jet water path 61.

Figure 6:
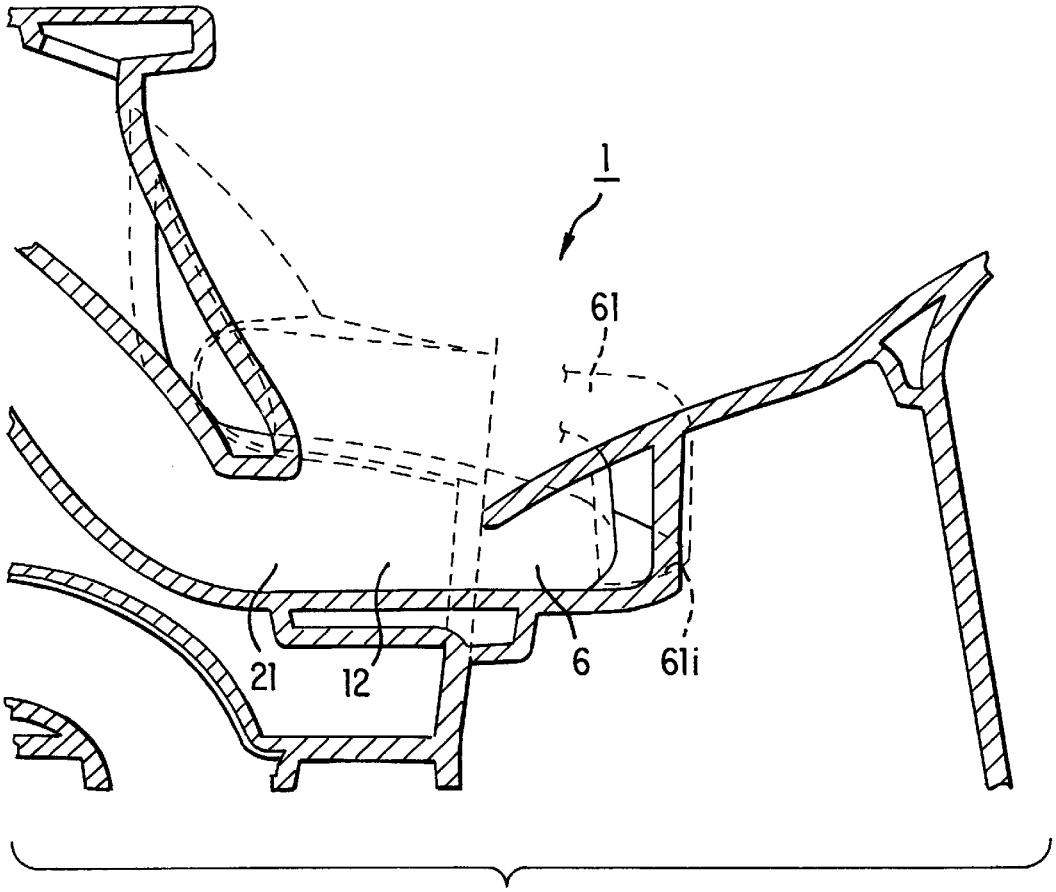
FIG. 6 is a fragmentary enlarged perspective view showing the vicinity of a jet water delivery port of a jet water path

To solve such a problem, the jet water path 61 in the present embodiment is formed so that it is made substantially horizontal directly below the surface of the gathered water to form a horizontal part 61*a* passing around toward the front part of the toilet bowl body A and, further, is turned by 180 degrees at the front part of the toilet bowl body A and, thereafter, drops in a straight line toward the jet delivery port 6. Further, to compensate for the influence of the centrifugal force, as shown in FIG. 6, the bottom surface of the portion of the water channel 61, where a change of direction in made by passing around to the front part of the toilet bowl body A, is formed with an inwardly inclined portion 61*a*. The radius of curvature of the bent portion 61*b*, where a change of direction of the jet water path 61 is made by turning by 180 degrees toward the jet delivery port 6 at the front the toilet bowl body A, amounts to a value of 20 to 30 mm. In addition, the upper portion of the jet water path 61 partially made adjacent to the water passing rim 3 and is provided at this adjacent portion with an air extracting hole 62 which passes through to the water passing rim 3 (refer to FIG. 2).

This construction of the jet water path 61 in the present embodiment allows the water, which has flowed down passing through the discharge port 5 from the flush water tank B, to be stopped momentarily at the horizontal part 61 *a*, so that the water gathered therein is formed in a short time between the flush water tank B and the horizontal part 61*a* and the surface of the gathered water rises. As a result, the air within the jet water path 61 is pushed up by the water, passes through the air extracting hole 62 into the water passing rim 3 and is discharged passing through the rim water outlet holes 32, 32'. Thereafter, the jet water path 61 is filled with water and the jet water is most strongly discharged. In other words, the air within the jet water path 61 is rapidly discharged, thereby allowing the tank head (water head) to be effectively utilized.

Moreover, in the construction of the present invention, the tank head acts on the interior of the jet water path 61, the energy supplied to the flushing water is determined depending purely on the fall between the flush water tank B and the jet delivery port 6. As a result, any resistance due to the provision of the horizontal part 61*a* can be ignored. It also follows that the embodiment of FIG. 1, which creates a higher pressure head will produce greater jet force. Moreover, since the radius of curvature of the bent portion 61*b* of the jet water guide path 61 that is turned by 180 degrees at the front part of the toilet bowl body A toward the jet delivery port 6 is formed at a value of 20 to 30 mm, the loss due to the change of direction of the flow in this portion also is small.

Figure 7A:
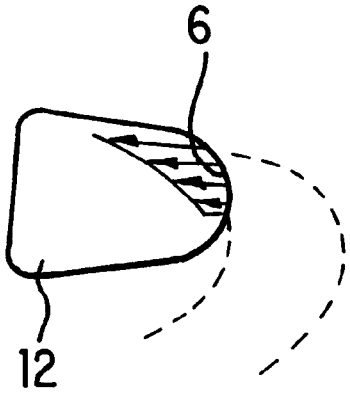
FIG. 7 is an explanative view showing a distribution of the velocity of flow of the delivered jet water, (a) showing a situation of the deflected distribution of the flow velocity and (b) showing a situation of the uniform distribution of the flow velocity.
Figure 7B:
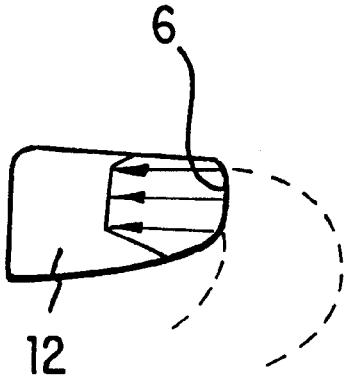

Further, making the jet water path 61 pass around up to the front part of the toilet bowl body A and making the jet water fall in a straight line from the front part of the toilet bowl body A toward the jet delivery port 6, as well as providing the inwardly inclined part 61*i* at the bottom of the water path 61 at the portion, where the above described jet water path 61 passes around, produces hardly any centrifugal force in the water delivered from the jet delivery port 6. As a result, the distribution of the velocity of flow from the jet delivery port 6 becomes uniform, as shown in FIG. 7(*b*). However, as shown in FIG. 7(*b*), the velocity of flow near the wall is decelerated by friction so that the velocity of the center of the flow is the maximum.

Making the distribution of the velocity of flow from the jet delivery port 6 uniform in this way, causes the water and sewage to be pressed by a flow of flushing water and sewage distributed in the form of a plane. As a result, the force of the water pressing against the sewage becomes strong, thereby enabling an increase in the discharging force to be expected. In contrast, in the case of the deflected distribution of the velocity of flow as shown in FIG. 7(*a*), water and sewage are pressed by a flow of flushing water and sewage that is not distributed in the form of a plane, but rather in the form of lines, and consequently, the force of water pressing the sewage and water becomes weak.

In addition to the means for revising the distribution of the velocity of flow—having the above-described construction, it is also possible to revise the distribution of the velocity of flow by a force of rotation due to the above-described rim water outlet holes 32, 32'.

Figure 8:
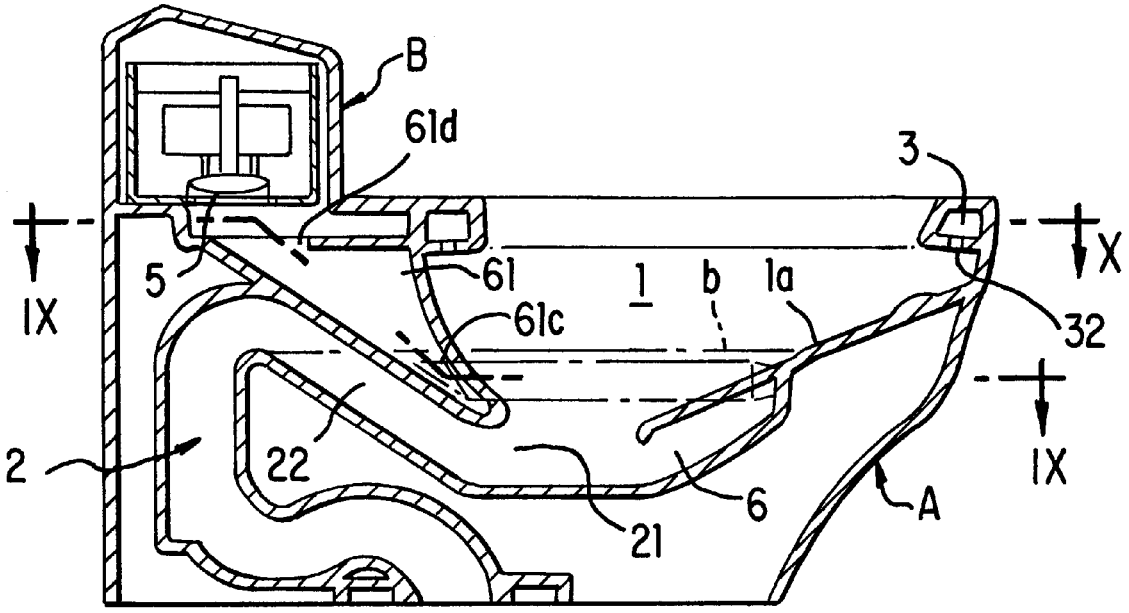
FIG. 8 is a central longitudinal sectional view showing another embodiment of the invention.
Figure 9:
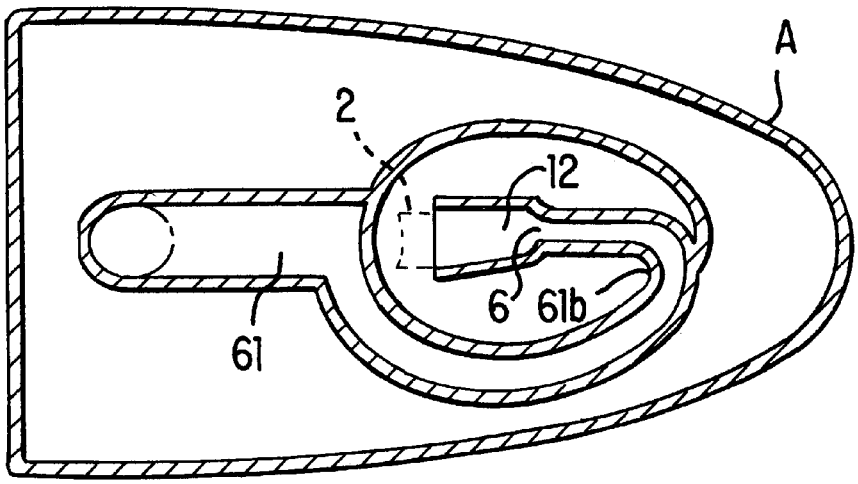
FIG. 9 is a sectional view taken along line IX—IX in FIG. 8.

FIGS. 8–11 show an alternative construction for a jet water path 61 and the water passing rim 3. In this construction, the jet water path 61 is provided in a position behind the discharge trap 2, as shown in FIG. 8.

The jet water path 61 extends from the discharge port 5 of the flush water tank B behind the discharge trap 2, along a rising channel 22 of the discharge trap (described later), up to the vicinity of the root of the discharge trap 2.

The jet water guide 61 continuously installed at the water discharge port 5 of the washing-water tank B extends the back positions of the drainage trap 2 up to the vicinity of the installation root of the drainage trap 2 along the drainage trap ascending path 22, which will be mentioned later, and changes the direction to the horizontal direction through a hole 61*c* opened in the side wall in the vicinity of the installation root. Then, it is introduced into the front part of the toilet bowl body A along the back face of the bowl part 1 and connected to the jet water discharge port 6 installed as opposed to the drainage trap inlet 21. Also, in the jet water guide 61, in order to reduce the initial air in the guide as much as possible, the part in front of the hole 61*c* of the side wall part is arranged so that it turns round the lower position of the stored water surface b.

At the upper part of the jet water guide 61 existing at the back position of the drainage trap 2, a branch port 61*d* for the water passage rim 3 is installed, and the water passage rim 3 is also connected via the branch port 61*d* to the drainage port 5 of the washing-water tank B.

According to the structure, the water discharged from the discharge port 5 of the washing-water tank B drops into the jet water guide 61 existing at the back position of the drainage trap 2 and then enters the hole 61*c* opened in the side wall in the vicinity of the installation root of the trap 2. At that time, since the flow direction is largely changed, a pipe resistance is caused here. For this reason, a large flow of water provided from the tank B is built up in a short time to the water guide 61, and the water surface of the stored water is raised. Thus, the tank head is operated in the water guide 61, and water is supplied to the water passage rim 3 through the branch port 61*d*. Also, since the above-mentioned branch port 61*d* is opened to the air through the water passage rim 3, the air in the jet water guide 61 is discharged to the outside through the branch port, and the state in which the tank head is operated can be easily guided.

In addition to the air discharge means with such a constitution, the air of the upper part of the jet water guide 61 may also be synchronized with the drainage valve opening operation and discharged to the outside of the jet water guide 61 by a pump, etc.

Figure 10:
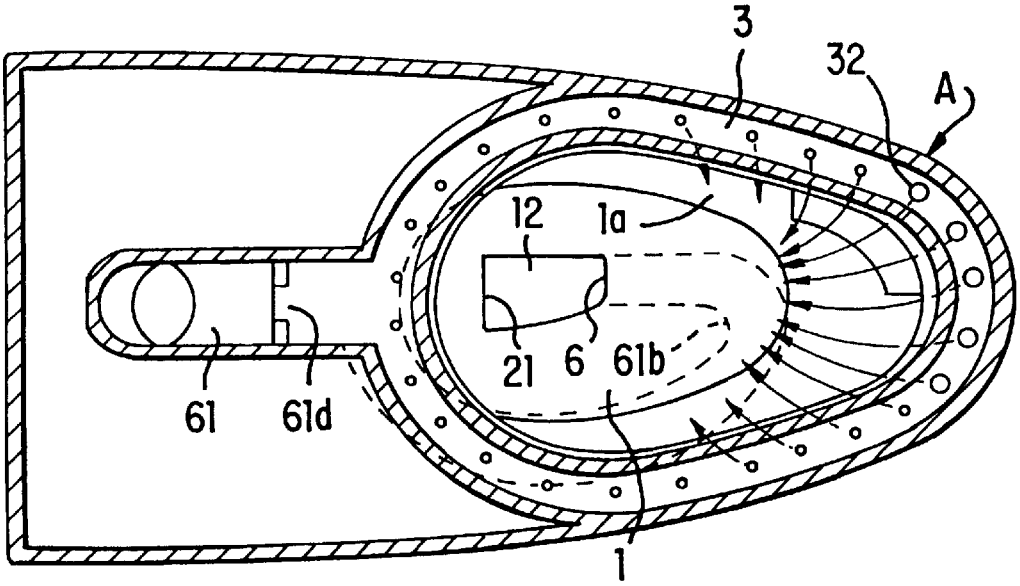
FIG. 10 is a sectional view taken along line X—X in FIG. 8.
Figure 11:
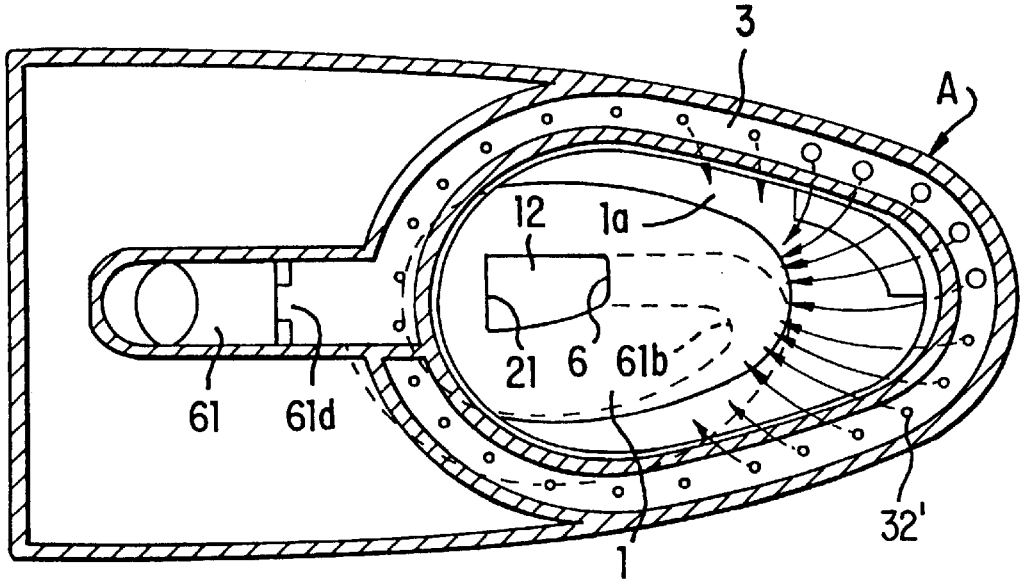
FIG. 11 is a view corresponding to FIG. 10, showing a modification of the embodiment shown in FIG. 10.

The washing water which flows into the water passage rim 3 and is provided into the bowl part 1 along the bowl surface 1*a* from the rim water discharge holes 32 and 32', as shown in FIGS. 10 and 11, rotates in one direction or both directions round the water passage rim 3 as shown in FIGS. 10 and 11, so that the flow of the washing water may or may not turn around the stored water surface b.

As the advantage of the structure of this embodiment being adopted in the jet water guide, since the path of the jet water guide 61 can be shortened, the jet flow force can be strengthened, and the above-mentioned water guide 61 can be molded in one piece, so that manufacturing characteristics can be improved.

On the other hand, in the drainage trap 2, as shown in FIG. 1, the inlet 21 is opened in the concave part 12 for dropping waste, which is installed at the bottom of the bowl part 1, and the drainage trap is constituted by a bent flow passage connected by an ascending path 22, which extends obliquely upward toward the rear side of the toilet bowl body A along the back face of the bowl part 1 from the inlet 21, a descending path 23, which extends nearly vertically toward the lower side from the upper end of the ascending path 22, and a horizontal pulling path 24, which extends horizontally in front of the toilet bowl body A from the lower end of the descending path 23. The discharge port 25 is opened in the vertical direction at the tip of the above-mentioned horizontal pulling path 24. Also, in case a separation is caused in a dam part 27, the water separated contacts with the inward wall of the drainage trap descending path 23, so that a disturbed flow is formed and rolls into the air. Thereby, a rapid air discharge is not enabled. Thus, the radius of curvature of the dam part 27 is 50–70 mm (about 0.9–1.4 times of the 55 mm diameter of the drainage trap), preferably 55–65 mm (about 1.0–1.2 times of the 55 mm diameter of the drainage trap), so that water does not come off the weir (dam) as far as possible.

This discharge trap 2 is of a double seal construction which constitutes the seal at two points on the way thereof. A means 26 for promoting the production of siphon is formed so that the outer wall surface extending downwardly in the downstream side of the weir 27 protrudes like a horizontal step inwardly of the trap 2, thereby causing the water passing over the upper end of the rising channel 22, i.e., the weir 27 and falling on the descending channel 23 to collide with the horizontal step. Moreover, a second weir 28 is of a upwardly bent portion which is formed by bending the cross-laid channel 24 upwardly so as to form a gathered water part 29 before the discharge opening 25. Preferably, as the length of the horizontal step of the above-described means 26 for promoting the production of siphon, a value of 15 to 25 mm (approximately 0.25 to 0.45 times the size of the diameter ϕ55 mm of the discharge trap) is preferable, and the gathered water part 29 due to the second weir 28 is preferably formed so as to have a ventilation room above the gathered water part (approximately 0.45 to 0.65 times the size of the diameter ϕ55 mm of the discharge trap).

The provision of the gathered water portion is significant in that the water that pools in this gathered water part reduces the area that must be sealed to obtain a siphon action without forming an immovable restriction to flow. Thus, providing a pool of water makes it possible to obtain fast siphoning notwithstanding the increased size of the fluid path, but the water can be pushed out of the way to allow passage of large masses of waste.

Further, the descending channel 23 is formed so that it is substantially cylindrical in shape in the direction of gravity and has a length of 100 to 150 mm (approximately 1.8 to 2.7 times the size of the diameter ϕ55 mm of the discharge trap) from the weir 27, and is further formed so that the gathered water part 29 is positioned substantially directly below the descending channel 23. The length dimension is important because if the descending channel 23 has a length of 150 mm or more, the water which has passed over the weir 27 collides with the back side wall of the descending channel 23 before reaching the means 26 for promoting the production of siphon, forms turbulent water into which air is drawn, making the rapid discharge of air impossible. If it has a length of 100 mm or lower, sufficient kinetic energy cannot be obtained to produce the seal in the means 26 for promoting the production of siphon, and in some cases the production of siphon does not occur.

Moreover, after the cross-laid channel 24 is bent upwardly to form the second weir 28, as described above, it is immediately bent in the downward direction to form a downward bent part 30, which in turn communicates with the discharge opening 25.

The above-described means 26 for promoting the production of siphon also has a function as a means 26 for altering the direction of flow. The position, where the flow direction revising means 26 is provided, is considerably important, and such means is provided in the position shown in the drawing, i.e., on the inner wall surface of the trap 2 at the portion where the descending channel 23 and the cross-laid channel 24 intersect with each other. Providing the flow direction revising means 26 in such a position allows the correction of a uneven distribution of the flow velocity to be performed. Uneven distribution of flow often occurs at the place where the water has finished turning the bent part continuing from the descending channel 23 of the discharge trap to the cross-laid channel 24.

As for the position of the flow direction revising means 26, the present inventors have found that a position higher than the center and lower than the ceiling wall by 10 to 20 mm with respect to the direction of height of the cross-laid channel 24, i.e., the level of substantially ⅔ of the ventilation room is most effective to perform the revision of a distribution of the velocity of flow and allows the air within the trap 2 to be rapidly discharged.

If the flow direction revising means 26 is provided at a position higher than the intersecting portion of the descending channel 23 and cross-laid channel 24, the distribution of the velocity of flow at the place where the water has finished turning the bent part which continues from the descending channel 23 to the cross-laid channel 24 becomes uneven. Moreover, the flow of water which is caused to be bent transversely by the flow direction revising means 26 in the form of a horizontal step sometimes becomes a flow which closes the trap 2, thus hindering the growth of siphon. Conversely, if this position is made lower than the above-described position, the effect of revising the velocity of flow becomes lower.

Further, the discharge trap 2 is formed so that the downward bent part 30 from the top of the bent part constituting the second weir 28 to the discharge opening 25 has a large radius of curvature of 40 to 65 mm (approximately 0.7 to 1.2 times the size of the diameter ϕ55 mm of the discharge trap), preferably 45 to 55 mm (approximately 0.8 to 1.0 times the size of the diameter ϕ55 mm of the discharge trap) and, simultaneously, the end of the discharge trap, in which the discharge opening 25 opens, reaches the same level as the bottom of the toilet bowl body A, thus a course of the water discharge being extended as long as possible. In the present embodiment, the downward bent portion 30 has a radius of curvature of 55 mm (1.0 times the size of the diameter ϕ55 mm of the discharge trap).

Moreover, FIG. 17 shows the water discharging characteristic, in which the radius of curvature of the downward bent part 30 from the top of the bent part constituting the second weir 28 of the discharge trap 2 to the discharge opening 25, is changed within a range of 10 to 55 mm.

As shown 17, in the case where the downward bent part 30 which is formed from the top of the bent part constituting the second weir 28 of the discharge trap 2 to the discharge opening 25 is smaller in the radius of curvature than 55 mm, as described above, the peak value of an amount of the discharged water less increases. The reason is that, in the discharge trap 2 having the cross-laid channel 24, as the flow of water changes from the transverse direction to the vertical direction before the discharge opening 25, the flow comes off the wall surface of the trap 2 and jumps forwardly to thereby decrease the area of the actual flow path near the discharge opening 25, so that the flow of water which has come off the wall comes to restrict the discharge of flushing water.

More specifically, FIG. 17(*a*) shows the result of an experiment made using the bent part 30 having a radius of curvature of 10 mm. In this case, the peak value of an amount of the discharged water from the discharge opening 25 amounts to 127 liters/min. and the amount of flushing water amounts to 6.3 liters. Further, FIG. 17(*b*) shows a case of the bent part 30 having a radius of curvature of 20 mm, and the peak value of an amount of the discharged water amounts to 140 liters/min. and the amount of flushing water amounts to 6.3 liters.

As shown in FIG. 17(*c*), in the case where the bent part 30 has a radius of curvature of 55 mm, the peak value of an amount of the discharged water amounts to 164 liters/min., which rises substantially by 30 percent compared with that of the example of (a) having a radius of curvature of 10 mm, and the amount of flushing water decreases to 6.125 liters. However, it shows the fact that there are several steps on the graph until the amount of the discharged water reaches the peak value thereof, and a process of producing the siphoning action is not sufficiently smooth.

Thus, as shown in FIG. 17(*d*), an attempt is made to use the bent part 30 having a radius of curvature of 55 mm and to continuously extend the edge portion 25*a* of the discharge opening 25 from the bent part 30. In this case, a phenomenon of the flushing water, which flows over the bent part 30, coming off the wall is more effectively suppressed, and the peak value of an amount of the discharged water amounts to 165 liters/min. and the amount of flushing water to 5.9 liters and, simultaneously, the number of the steps on the graph up to the peak value decreases, thereby making it possible to produce the siphoning action more smoothly. It follows that this design yields optimum flush characteristics.

In the case where the radius of curvature of the bent part is made larger than the above-described radius of curvature, the gathered water part is pressed and the sealing property is damaged and, accordingly, no siphoning action is caused and no data can be obtained.

Figure 12:
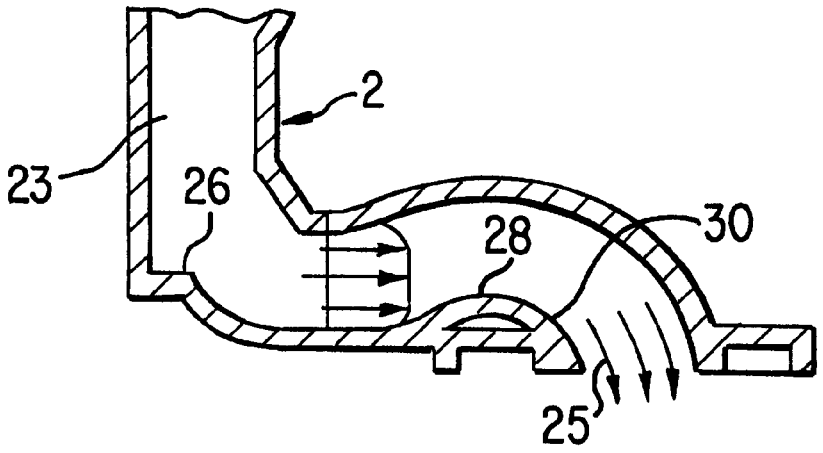
FIG. 12 is an explanatory view showing a distribution of the flow velocity in the vicinity of a discharge opening of the discharge trap

Therefore, in the case where the radius of curvature is increased to a value of 40 to 65 mm (approximately 0.7 to 1.2 times the size of the diameter ϕ of the discharge trap), preferably a value of 45 to 55 mm (approximately 0.8 to 1.0 times the size of the diameter ϕ of the discharge trap), the above-described phenomenon is prevented and a change of direction of the flow is made smooth and, consequently, the effective action in performed to smoothly induce the flow to the discharge opening 25 (refer to FIG. 12), thus providing an increase in the force of water discharge.

Further, the basis, on which 100 to 120 mm is taken as a value of the water level of the inner tank b2 when filled with water and 70 to 75 mm is taken as a value of the diameter of the discharge port, will be described with reference to FIGS. 13 and 14.

Figure 13:
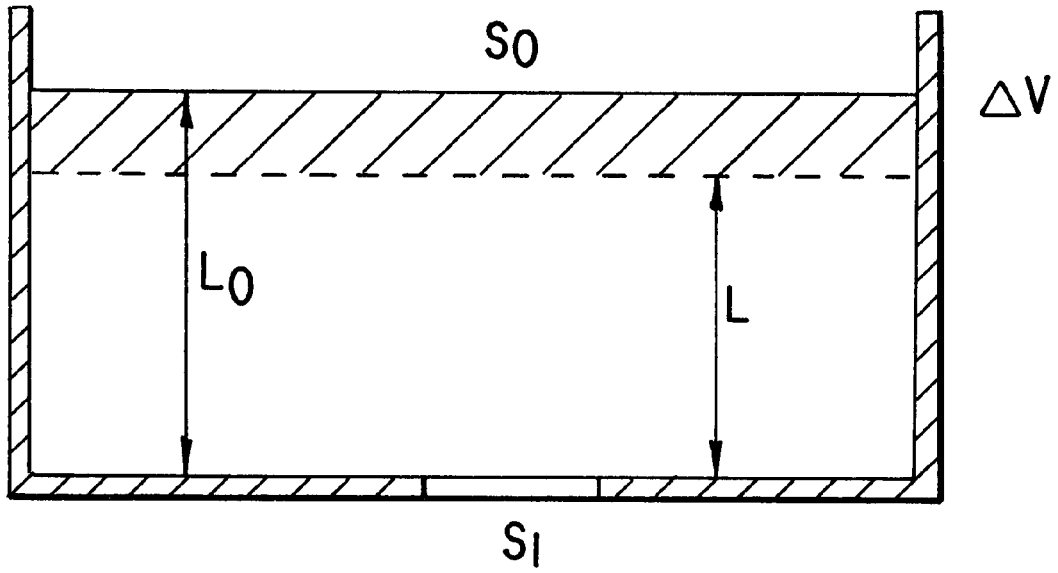
FIG. 13 is an explanatory view for explaining a relation between the height of the liquid surface in a flush water tank and the diameter of the discharge port as well as the instantaneous flow velocity of discharged water.

As shown in FIG. 13, if Lo represents the initial height of the surface of liquid, L the height of the surface of liquid after an elapse of Δt second, So the area of the liquid within the tank, S liter the sectional area of the discharge port, Vo the velocity of flow of the discharged water and ΔV the amount of the discharged water after an elapse of ΔT second, $$Vo = \sqrt{(2gLo)} \quad \text{(Equation 1)}$$

(potential energy=kinetic energy)

$$\Delta V = Vo \times Sl \times \Delta t = \sqrt{(2gLo)} \times Sl \times \Delta t \quad \text{(Equation 2)}$$

The velocity of flow of the discharged water after an elapse of ΔT second, $$V = \sqrt{(2gL)} \quad \text{(Equation 3)}$$

$$L = (So \times Lo - \Delta v)/So \quad \text{(Equation 4)}$$

Figure 14B:
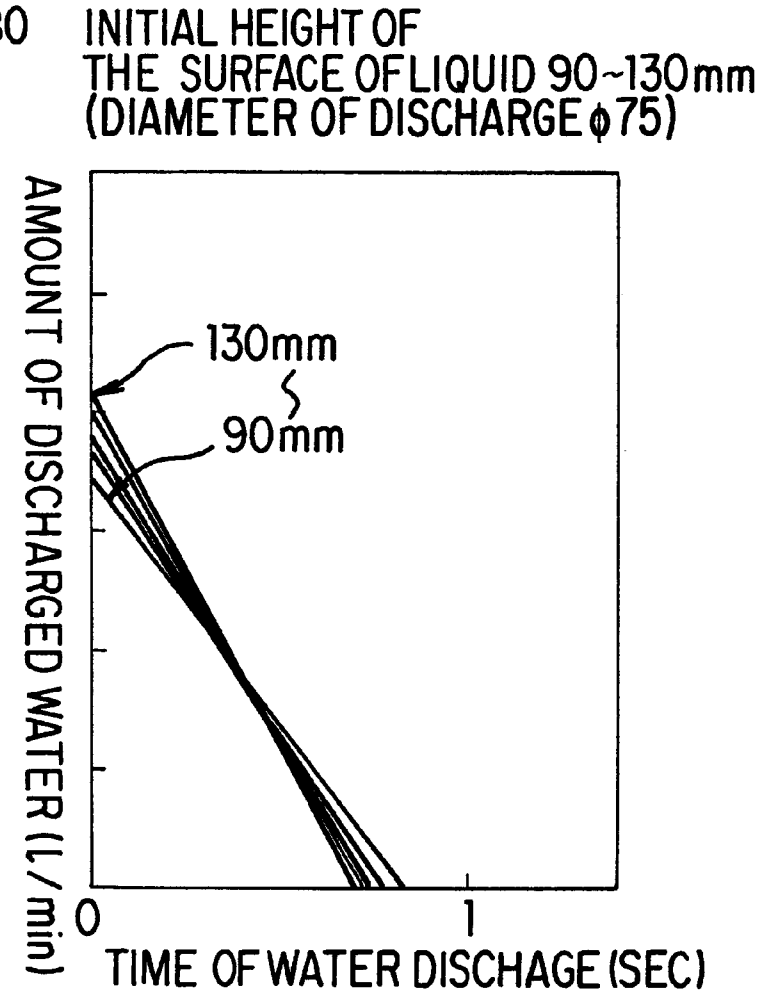
FIG. 14 is a graph showing a relation between the diameter of the discharge port of the flush water tank and the flow rate of discharged water, (a) showing a graph in the case where the initial height of the liquid surface is kept constant and the diameter is changed and (b) showing a graph in the case where the diameter is maintained constant and the initial height of the liquid surface is changed.
Figure 14A:
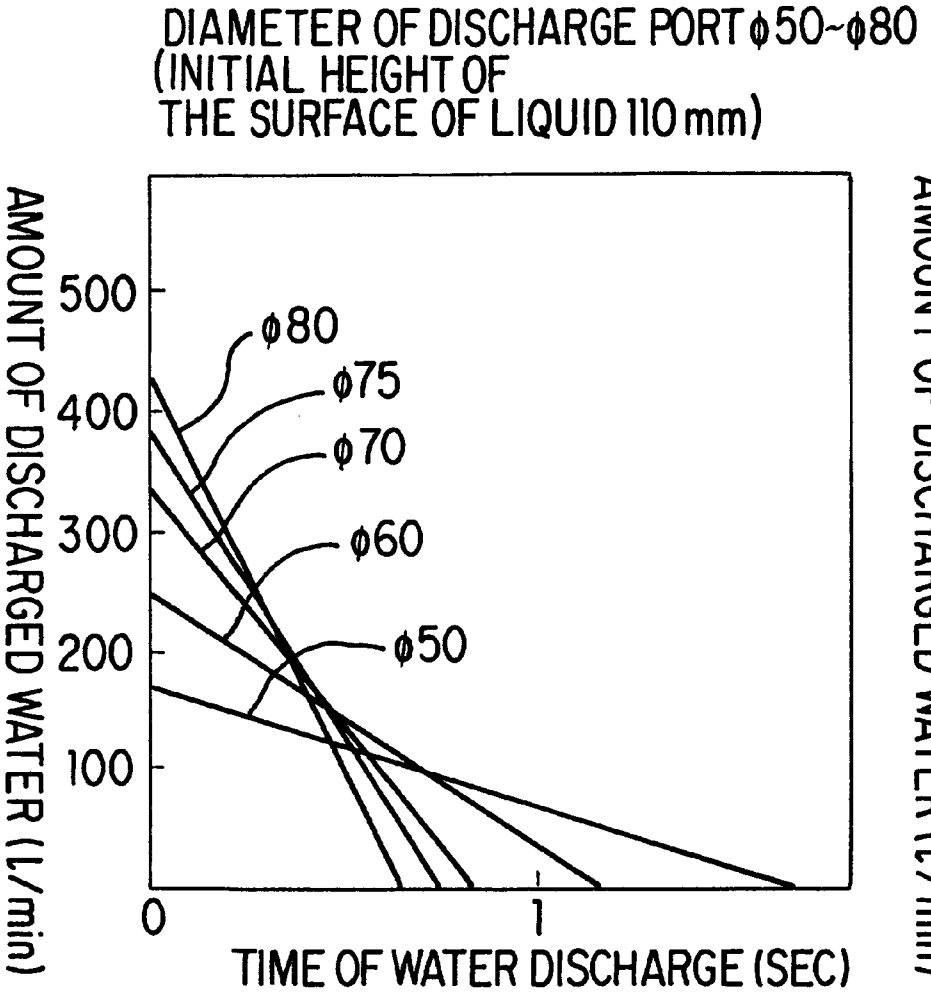

FIG. 14 shows a graph of the result obtained by calculating ΔT, for example, every 0.2 seconds and obtaining the amount of the discharged water ΔV at each time. FIG. 14(*a*) shows the result calculated using the initial height of the surface of liquid of 110 mm and the diameter of the discharge port in a range of ϕ50 to ϕ80 mm as a parameter, and FIG. 14(*b*) shows the result calculated using the diameter of the discharge port of ϕ75 mm and the initial height of the surface of liquid in 130 mm as a parameter.

Hereupon, it is empirically confirmed that the initial flow rate of 350 liters/min. and more and the time of supply of 0.7 seconds and more are necessary for production of the siphoning action in the case of the diameter ϕ55 mm of the discharge trap (taking only the production of the siphoning action into consideration, there is no upper limit on the time of supply, however, if the time of supply is too long, the amount of flushing water increases 60, if an attempt is made to suppress the amount of flushing water to 6 liters or 60, the time of supply is preferably one second and below). This condition has a mutual relation to the trap sectional area of the discharge trap, and it is confirmed that the water of supply of 0.24 liters/min. and more per a sectional area of 1 square cm is required (taking only the production of the siphoning action into consideration, there is no upper limit in the amount of supply, however, if the amount of supply is too much, the amount of flushing water increases; so, if an attempt is made to suppress the amount of flushing water to 6 liters or so, the amount of supply is preferably 0.30 liters/sec. and below per a sectional area of 1 square cm). Thus, offering the water of supply of 181 liters/min. and more, for example, in the case of the trap having the diameter ϕ40 mm, causes the siphoning action to be surely produced.

Therefore, as the values which satisfy the above-described condition, 100 to 120 mm for the initial height of the surface of liquid of and a range of 70 to 75 mm for the diameter of the discharge port can be selected from FIG. 14.

Figure 15:
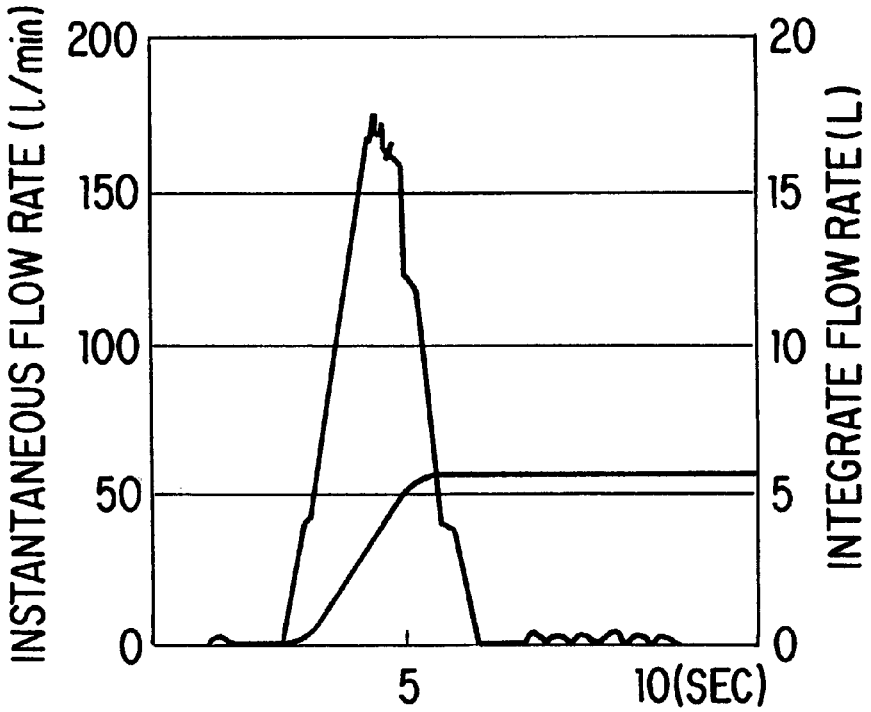
FIG. 15 is an explanative view showing a water discharging characteristic of the flush toilet bowl according to the present invention.
Figure 16:
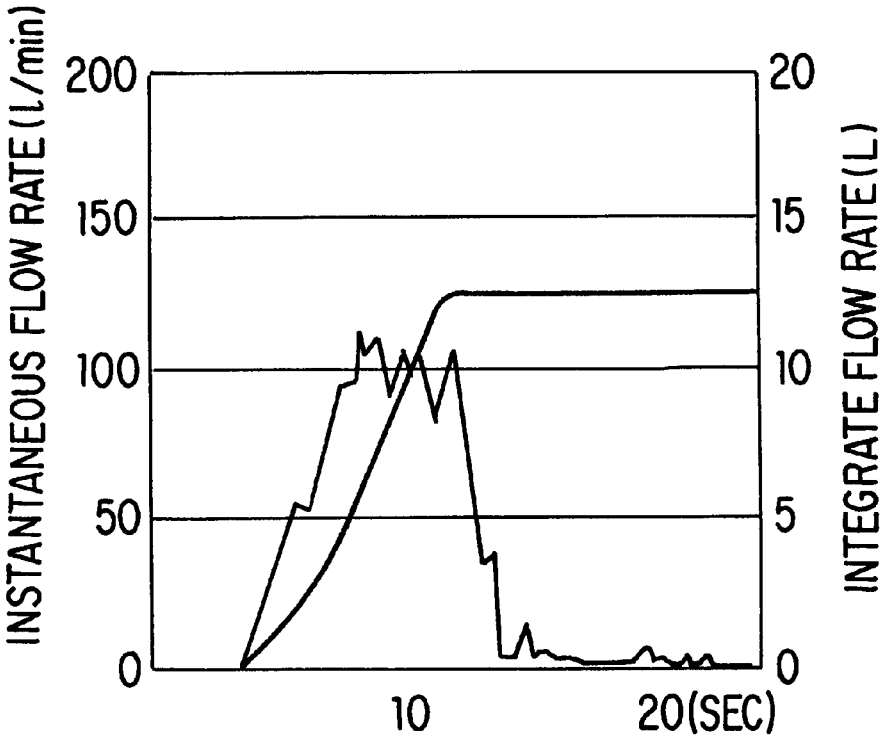
FIG. 16 is an explanative view showing a water discharging characteristic of a flush toilet bowl in the prior art.
Figure 17A:
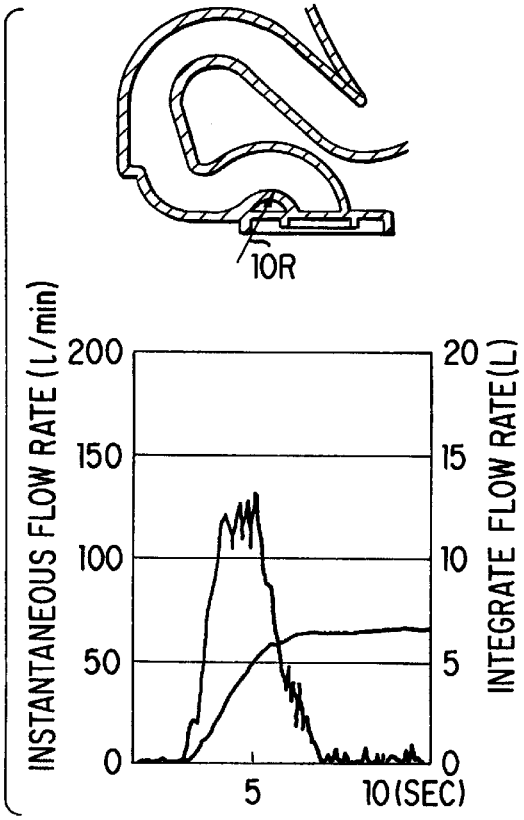
FIG. 17 is a view showing a relation between the radii of curvature of a bent part near the discharge opening of the discharge trap, (a) being of a radius of curvature of being of a radius of curvature of 10 mm, (b) being of a radius of curvature of 20 mm, (c) being of a radius of curvature of being of a radius of curvature of 55 mm, and (d) being of a radius of curvature of 55 mm and, simultaneously, showing a portion of the bent part continuously extended more downwardly than the discharge opening.
Figure 17B:
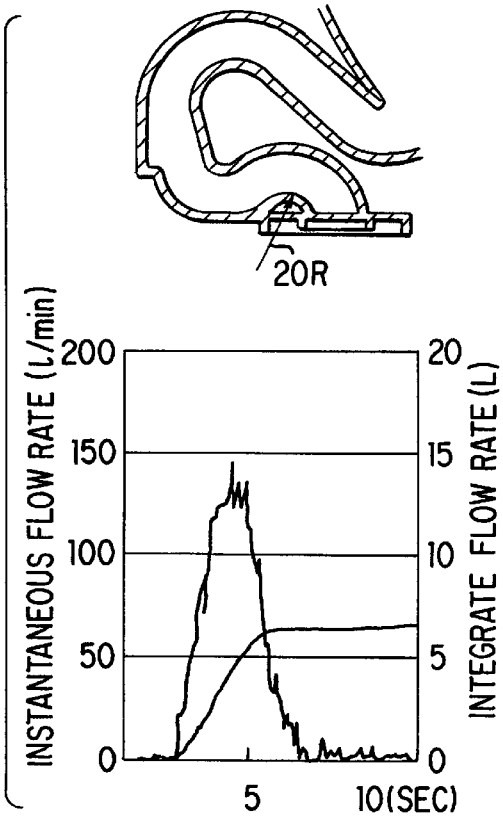
Figure 17C:
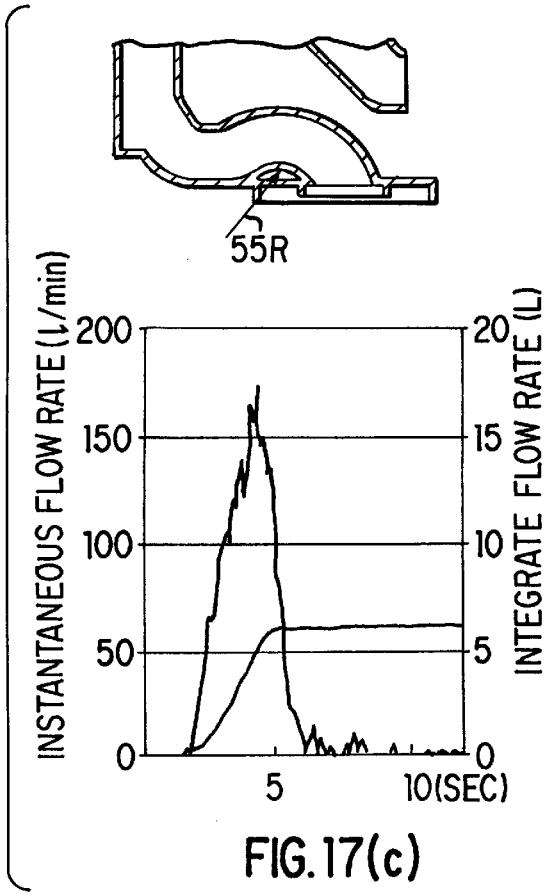
Figure 17D:
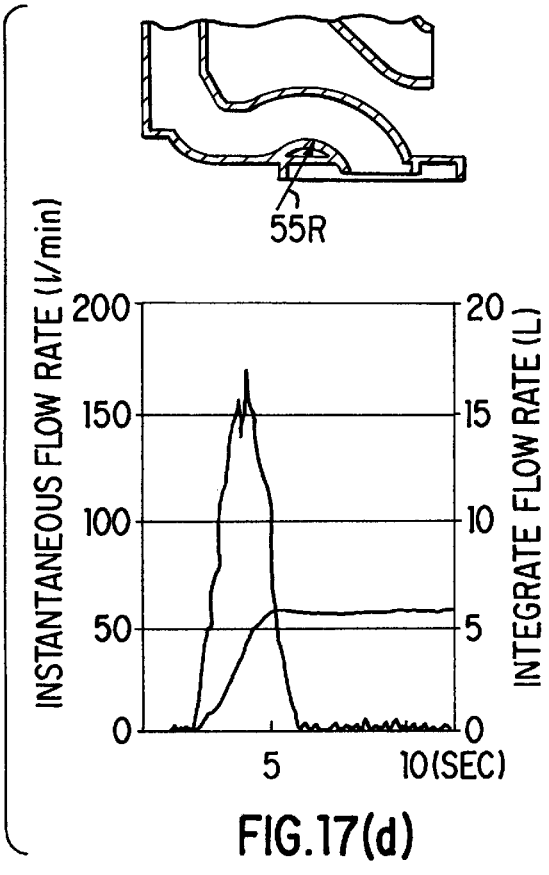

An experiment is made for comparison of the performance of water discharge of the toilet bowl according to the invention having the construction as described above with a siphon vortex type toilet bowl which is typical as a conventional low-silhouette type toilet bowl. As a result, the water discharging characteristic of the toilet bowl according to the invention is shown in FIG. 15, and the water discharging characteristic of the conventional low-silhouette type toilet bowl is shown in FIG. 16. As understood from these graphs, in the water discharging characteristic of the conventional low-silhouette type toilet bowl, the peak of the water discharge: 110 liters/min., the time required until the peak of the water discharge 5.3 seconds, and the integrated flow: 12.7 liters, while in the water discharging characteristic of the toilet bowl according to the invention, the peak of the water discharge: 167 liters/min., the time required until the peak of the water discharge: 1.8 seconds and the integrated flow rate: 5.5 liters. However, in order to obtain the above-described result, it is important for the toilet bowl according to the invention that the velocity of flow of the jet of 1.3 m/sec. and more is required for a period of time of 1.4 seconds and more, and the sectional area of the opening of the jet lies within 30 to percents of the sectional area of the trap. Moreover, the sectional area of the opening of jet in the toilet bowls used in the present experiment are 10 square cm (as the trap is viewed to be a circle of the diameter of 55 mm, a ratio of the sectional area of the jet to that of the trap is 0.42).

In order to discharge the sewage within the toilet bowl by a small amount of flushing water, there is not enough of a pressing-out force due to the flushing water and, therefore, this must be compensated by the suction force due to the siphoning action. Further, the shorter the time taken to produce the siphoning action is, the smaller the amount of the supply of flushing water is. In this connection, the time required for conveying sewage by the continuation of the siphoning action has a mutual relation to the suction force, and if the suction force is strong, the time required for conveying sewage can be made short.

Figure 18:
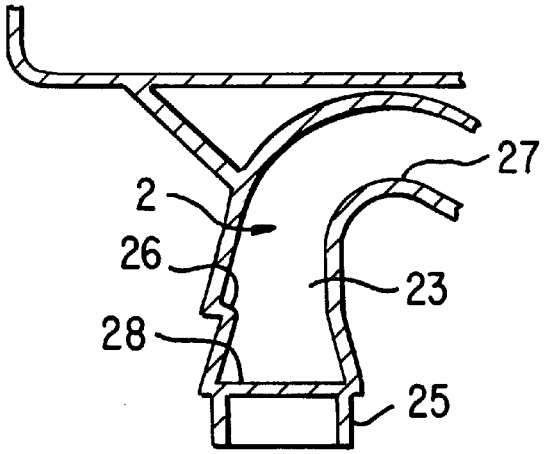
FIG. 18 is an enlarged fragmentary sectional view showing a further embodiment of the discharge trap.
Figure 19:
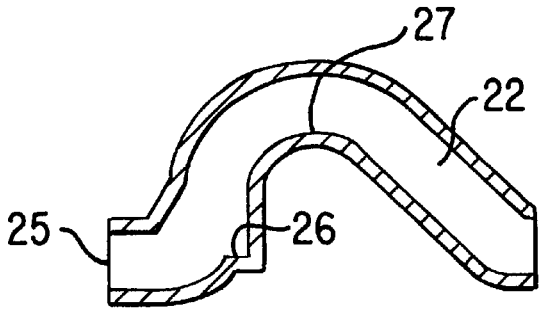
FIG. 19 is an enlarged fragmentary sectional view showing still a further embodiment of the discharge trap.
Figure 20:
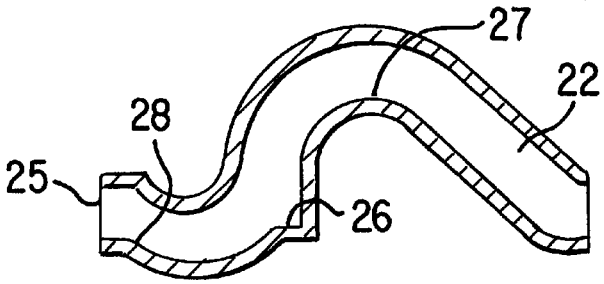
FIG. 20 is an enlarged fragmentary sectional view showing Another embodiment of the discharge trap.

The water discharging characteristic obtained empirically with such a knowledge as a basis is that of the invention as described above. Therefore, other discharge traps that have the above-described water discharging characteristics can be used. For example, different constructions, such as those shown in FIGS. 18 to 20, could be used. In the constructions shown in FIGS. 18 to 20, the same parts as the construction of each embodiment as described above are indicated by the same reference characters, and the explanation thereof is omitted.

Figure 21:
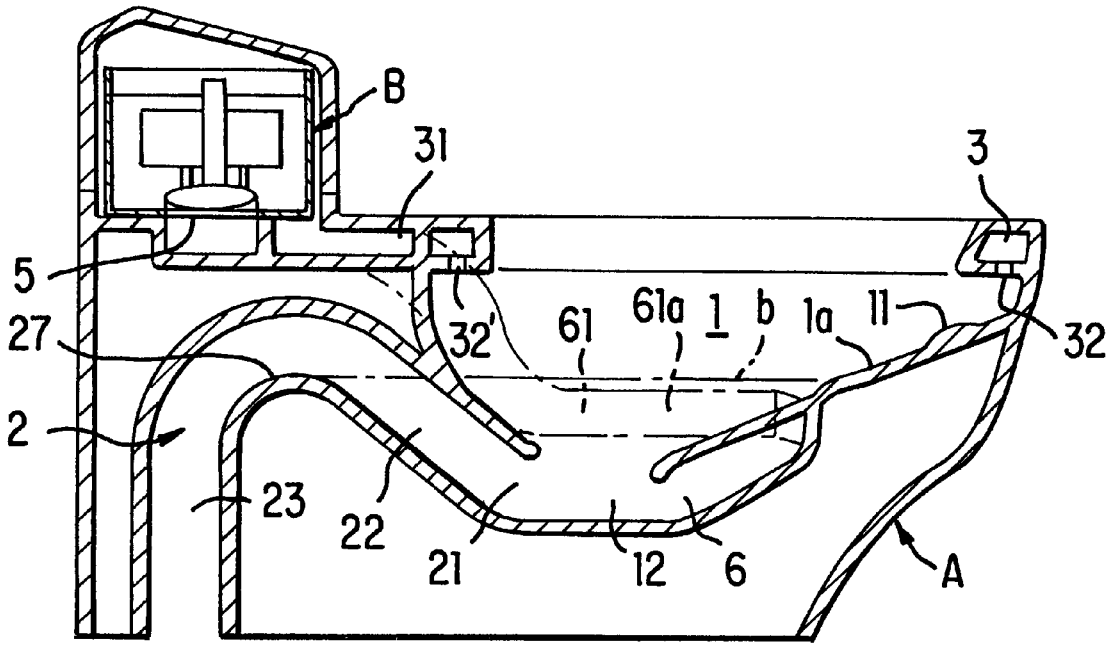
FIG. 21 is a central longitudinal sectional view showing a further embodiment of the flush toilet bowl according to the invention.

Moreover, designing the above-described jet water path 61 enables the production of the siphon to be ensured without providing any seal producing means in the discharge trap 2, as shown in FIG. 21. However, in this case, it is empirically confirmed to require a flow of 6 to 8 liters or so.

Further, another embodiment of the jet water path will be described.

Figure 22:
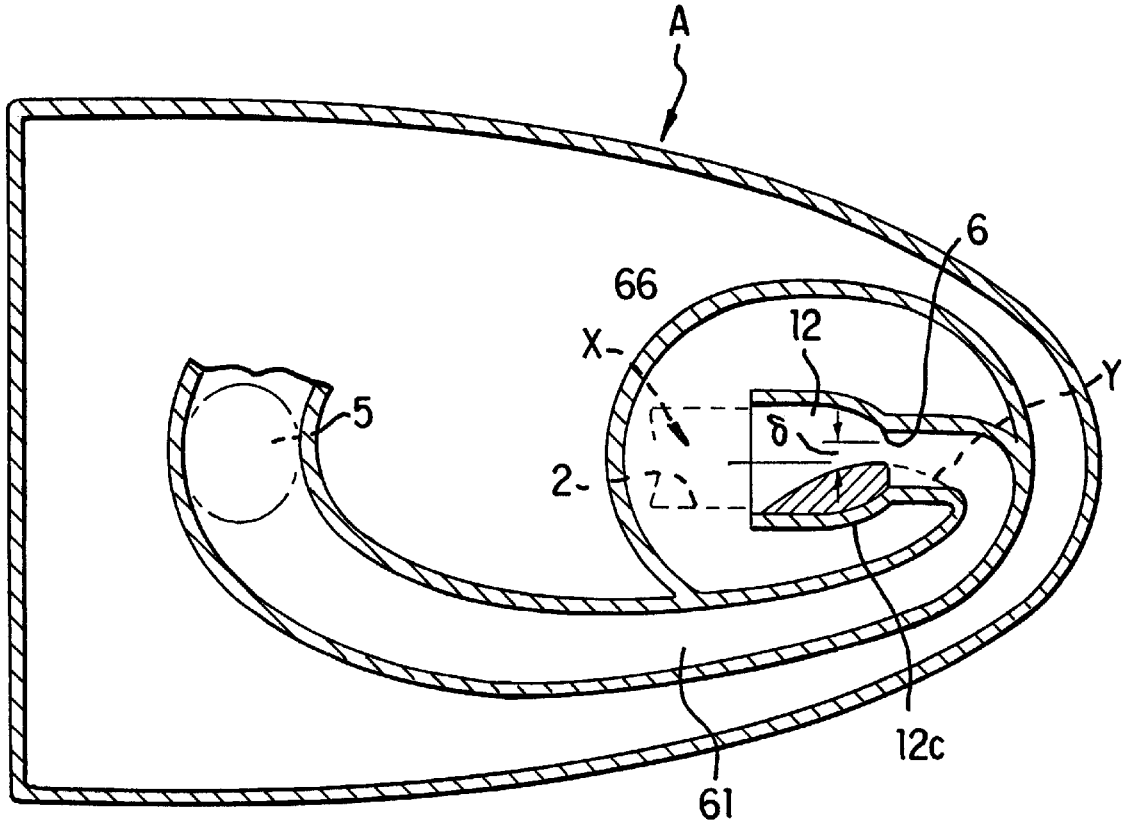
FIG. 22 is a cross-sectional view showing another embodiment of a jet water path.

In the embodiment shown in FIG. 22, the jet delivery port 6 of the jet water path 61 is additionally provided with an offset block. Namely, the sewage dropping recess 12 is additionally provided on the left wall 12*c* thereof with the offset block 66 in the form of a triangle so that the jet delivery port 6 is offset by δ from the center of the discharge trap 2.

Figure 23:
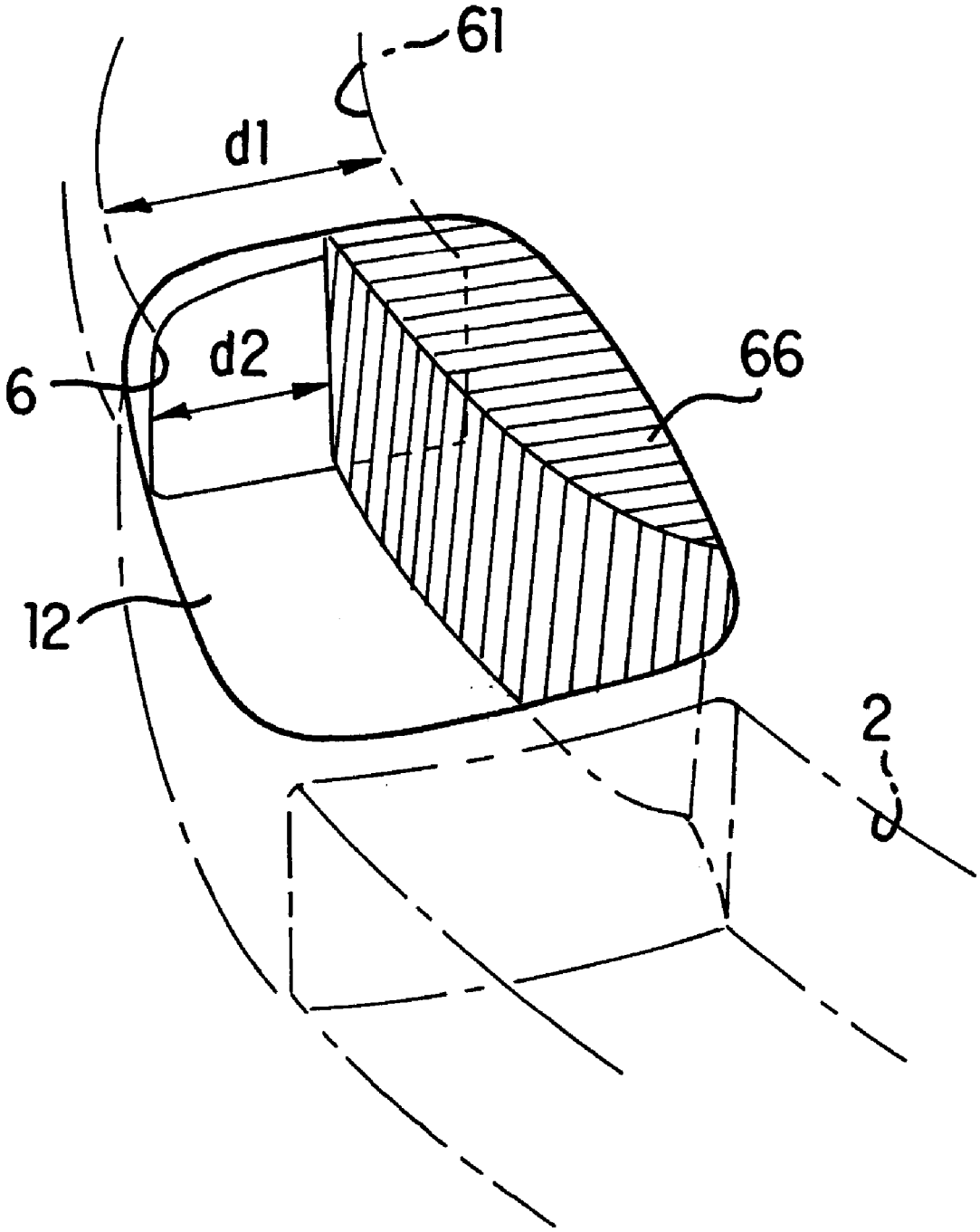
FIG. 23 is a fragmentary perspective view as viewed in the arrow-marked direction X in FIG. 22.

FIG. 23 is a perspective view as viewed from the arrow-marked direction X in FIG. 22, which shows that the jet delivery port 6 of the jet delivery path 61 having a width of d1 is blocked by the offset block 66, so that the jet delivery port 6 is reduced to a width of d2.

Also, the above-mentioned block 66 for an offset may have a wing section shape including the part shown by a line Y of alternating long and double short dashes in FIG. 22. In this embodiment, since the toilet bowl can be manufactured by installing the block 66 for an offset at the toilet bowl body A in which the tip of the jet water guide 61 is fitted to the center of the toilet bowl, the manufacturing cost is not likely to be raised high, and the flow passage loss is not increased to the extreme.

FIG. 24 is a comparison chart between this embodiment and the comparative example. For convenience, a plan view (principle diagram) was shown, however in case the rim washing water turned to the right, from the rim side, the block 66 for an offset toward the left (that is, the offset direction was right) was assumed as this embodiment, then the block for an offset (that is, no offset) was Comparative Example 1, and the block 66 for an offset toward the right (that is, the offset direction was left) was Comparative Example 2.

First, in a noise test, in this embodiment, the water washing sound including the siphon cutoff sound was 65.0–66.8 dB (A), averaging 66.2 dB (A).

However, the measuring point was a position which was separated at 1.0 m above the rim surface of the toilet bowl and at 1.0 m in front (beyond the rim) from the installation hole of the toilet seat. As the average value, the position was measured 5 times under the same conditions, and these measured values were simply averaged.

In Comparative Example 1, the water washing sound was 64.3–69.0 dB (A), an average 66.8 dB (A), and in Comparative Example 2, the water washing sound was 65.6–68.4 dB (A), an average 67.0 dB (A).

As a result of evaluating by the average value, this embodiment is o, Comparative Example 1 is Δ, and Comparative Example 2 is x.

Next, reviewing the above-mentioned evaluation, in Comparative Example 1, the peak of the flow distribution of the jet water for the rim turning flow to the right is inclined to the left from the center. As a result, it is considered that the air is absorbed from the right end with a small flow, which raises the water washing sound.

In Comparative Example 2, since the offset direction is opposite, the peak of the flow distribution is largely inclined to the left, so that the water washing sound is raised.

On the other hand, in this embodiment, the peak of the flow distribution returned to the center by offsetting to the right, so that the water washing sound could be lowered.

Figure 25:
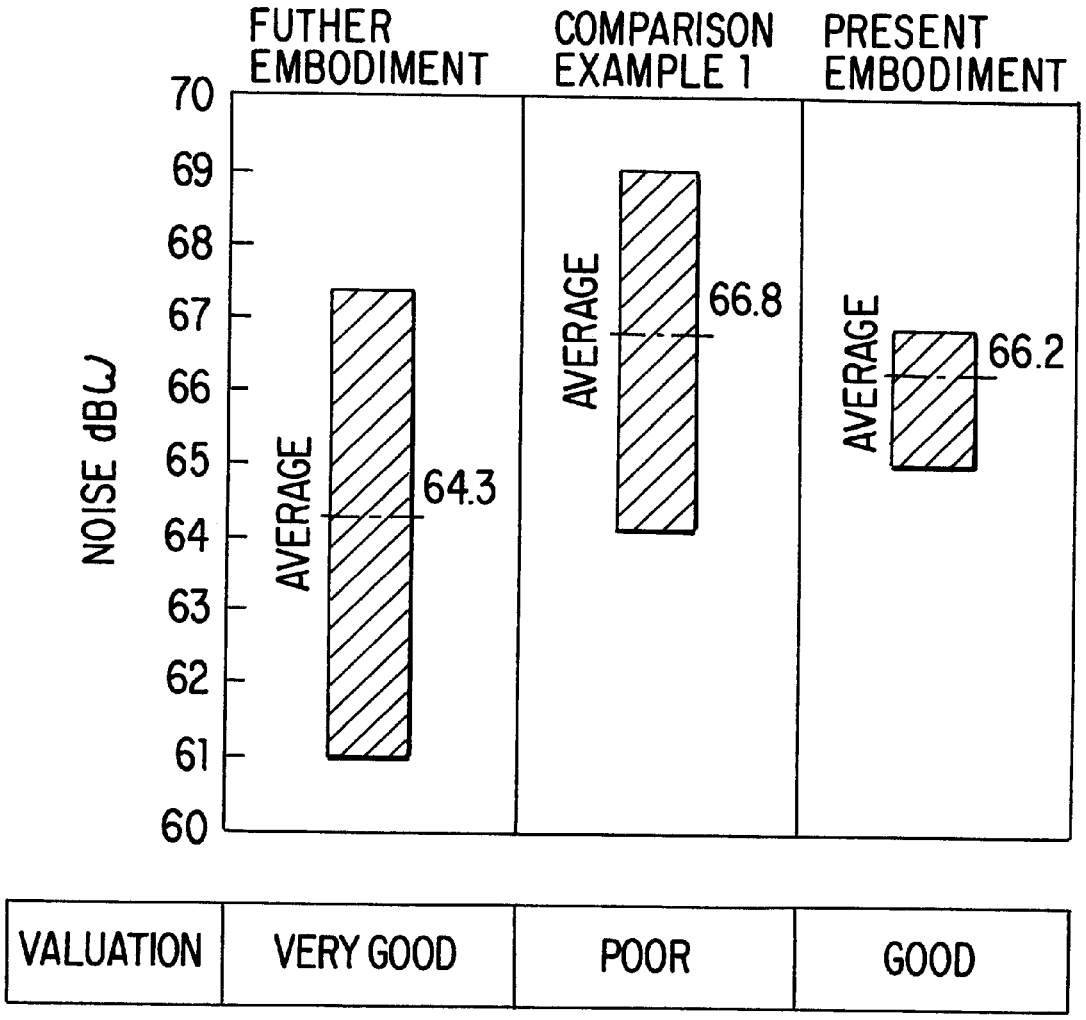
FIG. 25 is a view for comparison of a further embodiment according to the invention with a comparison example.

FIG. 25 is a comparative graph of another new embodiment and the other examples.

In another embodiment, the rim discharge hole with a large diameter and the block 66 for an offset are appropriately arranged. In other words, the rim water discharge holes 32 and 32' as shown in FIG. 2 are combined in this embodiment.

In Comparative Example 1 and this embodiment, for comparison with another embodiment, experimental results shown in FIG. 24 are transferred.

According to another embodiment, with the multiplication effect due to the improvement of the turning characteristic of the washing water being discharged from the rim water discharge hole from the rim water discharge hole 32 with a large diameter and the appropriateness of the flow distribution due to the block for an offset, since the water washing sound was 61.0–67.4 dB (A), an average 64.3 dB (A) and the average value was greatly improved, compared with other examples, the evaluation was very good.

Figure 26A:
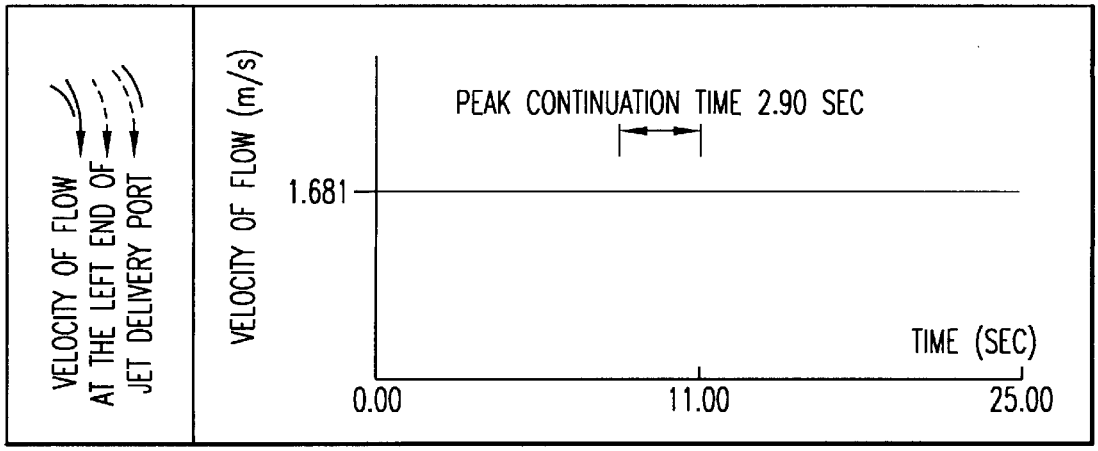
FIG. 26 is a view showing a relation between the flow velocities from the jet delivery port and the flow velocity characteristics, (a) showing a relation to the flow velocity at the left end of the jet delivery port, (b) showing a relation to the flow velocity in the center of the jet delivery port and (c) showing a relation to the flow velocity at the right end of the jet delivery port.
Figure 26B:
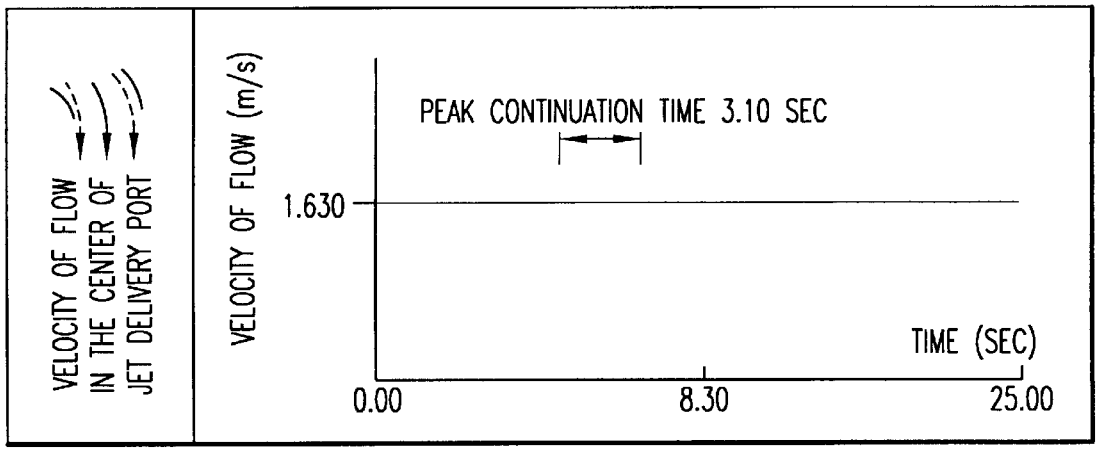
Figure 26C:
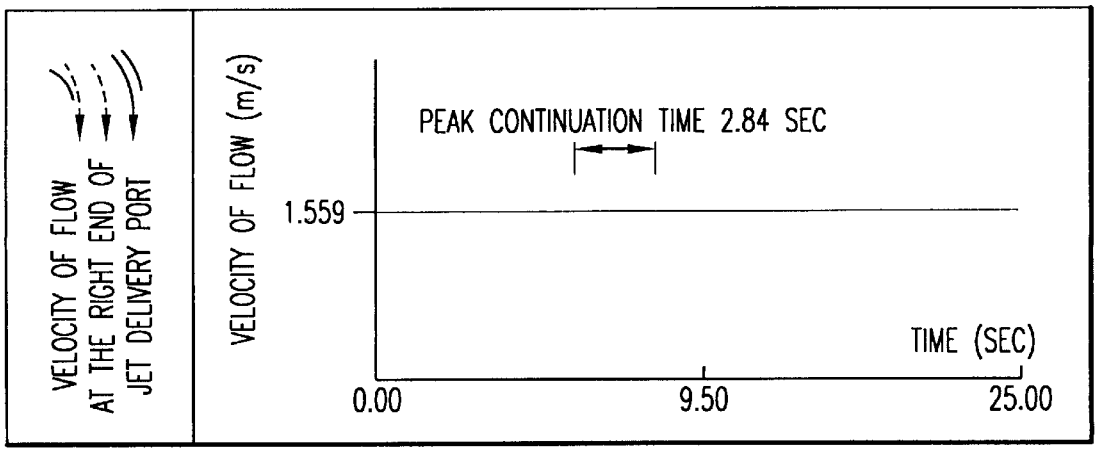
Figure 27:
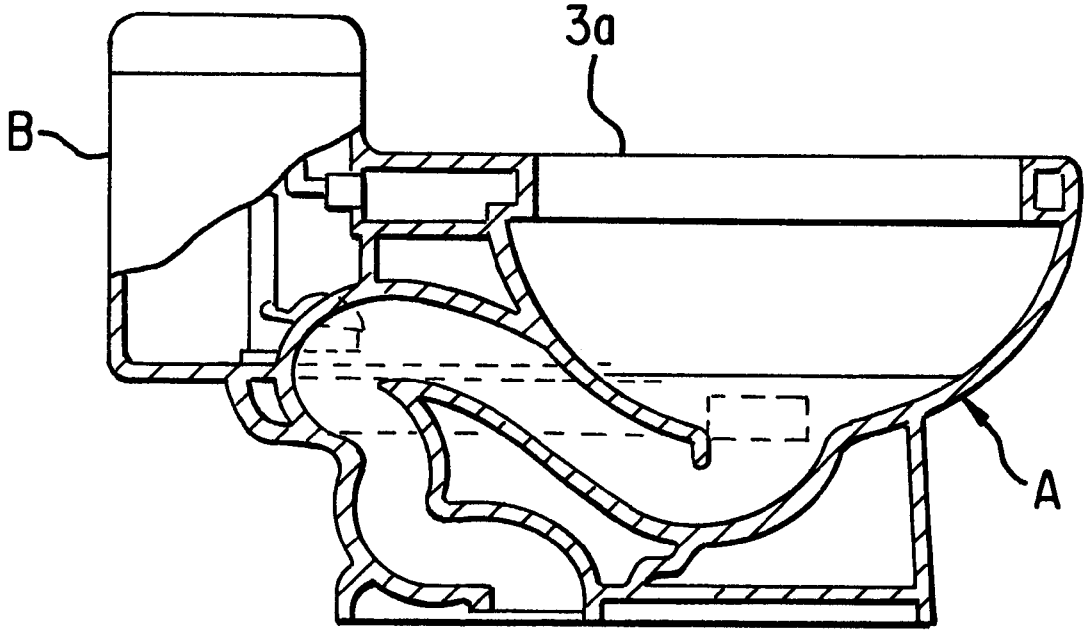
FIG. 27 is a central longitudinal sectional view showing an example of a flush toilet bowl in the prior art.

Also, for the embodiment shown in FIGS. 1–4, when the flow from the jet water discharge port was divided into two regions of the right, center, and left, and measured, the flow characteristics shown in FIG. 26 were obtained. Comparing FIG. 26 with FIG. 15, in particular, the flow from the jet water discharge port in FIG. 26(*a*) reaches the peak in about 0.3 sec after opening the tank drainage valve, and the potential energy obtained from the tank is used up in about 1.0 sec. However, it is considered that since the siphoning action has already been generated, the flow in the vicinity of the jet water discharge port maintains 1.5 sec or more by the attraction due to the generation of the siphoning action. Also, in case FIG. 26 and FIG. 15 are compared, it is necessary to compare them by superposing assuming the rise timing of the respective waveform line as a reference point. Also, in FIGS. 26(*a*), (*b*), and (*c*), the respective time axis is not consistent, however the reason for this is that the respective synchronization is not obtained when recording the waveform line. Therefore, in these graphs, the absolute value (for example, 1.00 and 25.00 of (a)) of the time axis is not a numerical value with a special meaning. This is also similar to FIG. 15.

Thus, the flow from the jet water discharge port is continued longer by operating the attraction due to the siphoning action to the flow the jet water discharge, so that fine waste, etc., can be reliably discharged.

The present invention provides a flush toilet bowl which allows the production of a siphoning action within the discharge trap to be promoted and also allows the large flushing capacity to be displayed with a small amount of flushing water.

Further, the present invention provides a flush toilet bowl which allows the large flushing capacity to be displayed with a small amount of flushing water by effectively producing a jet flow from the jet water delivery port and causing the production of a siphoning action within the discharge trap more surely. The invention being thus described, it will be obvious that the same may be varied in many ways. Such variations are not to be regarded as a departure from the spirit and scope of the invention, and all such modifications as would be obvious in the art are intended to be included within the scope of the following claims.

We claim:

1. A flush toilet bowl comprising:

a toilet bowl body having a bowl part and a discharge trap extending from a location proximate the bottom of the bowl part, the bowl part having a rim portion that has an upper rim surface;

a flush water tank disposed at the back of said toilet bowl body, the flush water tank including a discharge port that opens into the flush water tank at a predetermined level, the flush water tank containing a first predetermined volume of water that is located above the level of the discharge port and adapted to be discharged through the discharge port;

a valve assembly for sealing the discharge port so as to prevent the discharge of flush water from the tank, the valve assembly including a valve body that is movable between a closed position wherein the valve body blocks the discharge opening so as to prevent the discharge of flush water from the tank and an open position wherein the valve body is spaced from the discharge port so that flush water may be discharged from the tank through the discharge port, the valve assembly, including a valve body having a predetermined weight, the valve body being supported on a support arm having a predetermined weight, the support arm being pivotably supported within the tank about an axis that is spaced from the valve body;

the valve assembly further comprising a force transmitting member for allowing a user to move the valve body from the closed position to the open position to initiate flushing, the valve assembly being designed to allow the valve body to return to the closed position so as to prevent the discharge of flush water from the tank before the entire first predetermined volume of water that is located above the level of the discharge port is discharged through the discharge port whereby only a second predetermined volume of water, which is less than the first predetermined volume of water, is discharged through the discharge port so that the difference between first predetermined volume of water that is located above the level of the discharge port and the second predetermined volume of water, which is actually discharged through the discharge port is a third volume of water that is used to pressurize the water that is actually discharged;

wherein the weight of the valve body and support arm being arranged relative to the pivot axis such that the valve body is always biased into the closed position so as to being moving toward the closed position without delay upon release of the force transmitting member by the user; and a water passage connecting the discharge port to the toilet bowl.

2. A flush toilet bowl as claimed in claim 1, wherein the first predetermined volume of water that is located above the level of the discharge port and adapted to be discharged through the discharge port is greater than 6 liters and wherein the second predetermined volume of water is 6 liters or less.

3. A flush toilet bowl as claimed in claim 1, wherein the water passage connecting the discharge port to the toilet bowl includes a jet water path that connects the discharge port of said flush water tank to a jet water delivery port provided facing the inlet of said discharge trap;

said jet water path having a bent part turning the direction of flow toward the jet water delivery port before the jet water delivery port, and said jet water delivery port being provided in the vicinity thereof with a means for revising a distribution of the velocity of flow, said means performing the revision of the distribution of the velocity of flow so that the velocity of flow substantially in the center of the jet water delivery port becomes the maximum.

4. A flush toilet bowl as claimed in claim 3, wherein the means for revising the distribution of the velocity of flow is of a construction of the axis of said jet water delivery port being offset to the inner peripheral side of said bent part.

5. A flush toilet bowl as claimed in claim 3, wherein the means for revising the distribution of the velocity of flow comprises an inclined surface formed by tilting the bottom of the bent part of the jet water path toward the inner peripheral side.

6. A flush toilet bowl as claimed in claim 3, wherein the bent part of the jet water path is formed having a radius of curvature of 20 to 30 mm.

7. A flush toilet bowl as claimed in claim 3, wherein the jet water path has a cross-sectional area which amounts to 0.3 to 0.6 times the cross-sectional area of the discharge trap.

8. A flush toilet bowl as claimed in claim 1, wherein the discharge port is positioned substantially at the same level as the rim surface of the toilet bowl body.

9. A flush toilet bowl as claimed in claim 1, wherein the force transmitting member allows a user to hold the valve body in the open position so as to discharge a volume of water that is greater than the second predetermined volume of water.

10. A flush toilet bowl as claimed in claim 1, wherein the valve body is free to return to the closed position so as to prevent the discharge of flush water from the tank when the force transmitting member is released by the user.

11. A flush toilet bowl as claimed in claim 1, wherein the flush water tank is formed so that it has a water level greater than 120 mm, but only the volume contained in a height of 100 to 120 mm is discharged during flushing.

12. A flush toilet bowl as claimed in claim 1, wherein the discharge port has a diameter between 70 and 75 mm.

13. A flush toilet bowl comprising:

a toilet bowl body that includes a bowl part having an upper end and a lower end with a bottom part at the lower end and a discharge trap extending from the bottom of said bowl part, the discharge trap including a rising channel having an upper end and a lower end and the rising channel extending in the obliquely upward direction from the bottom of the bowl part; a first weir formed at the upper end of said rising channel; a descending channel extending downwardly from said first weir; and a cross-laid channel extending substantially horizontally from the lower end of said descending channel and having a discharge opening at the end thereof, said cross-laid channel being provided with an upwardly bent second weir between the lower end of said descending channel and the discharge opening, and being formed with a gathered water part between said second weir and the lower end of said descending channel, said descending channel being formed in the vicinity of the lower end thereof with a horizontal part extending horizontally toward said cross-laid channel the flush toilet further comprising a flush water tank disposed at the back of said toilet bowl body, the flush water tank including a discharge port that opens into the flush water tank at a predetermined level, the flush water tank containing a first predetermined volume of water that is located above the level of the discharge port and adapted to be discharged through the discharge port;

a valve assembly for sealing the discharge port so as to prevent the discharge of flush water from the tank, the valve assembly including a valve body that is movable between a closed position wherein the valve body blocks the discharge opening so as to prevent the discharge of flush water from the tank and an open position wherein the valve body is spaced from the discharge port so that flush water may be discharged from the tank through the discharge port, the valve assembly, including a valve body having a predetermined weight, the valve body being supported on a support arm having a predetermined weight, the support arm being pivotably supported within the tank about an axis that is spaced from the valve body and the weight of the valve body and support arm being arranged relative to the pivot axis such that the valve body is always biased into the closed position, the valve assembly further comprising a force transmitting member for allowing a user to move the valve body from the closed position to the open position to initiate flushing; and a water passage connecting the discharge port to the toilet bowl.

14. A flush toilet bowl as claimed in claim 13, wherein the valve assembly is designed to allow the valve body to return to the closed position so as to prevent the discharge of flush water from the tank before the entire first predetermined volume of water that is located above the level of the discharge port is discharged through the discharge port whereby only a second predetermined volume of water, which is less than the first predetermined volume of water, is discharged through the discharge port so that the difference between first predetermined volume of water that is located above the level of the discharge port and the second predetermined volume of water, which is actually discharged through the discharge port is a third volume of water that is used to pressurize the water that is actually discharged, and wherein the first predetermined volume of water that is located above the level of the discharge port and adapted to be discharged through the discharge port is greater than 6 liters and wherein the second predetermined volume of water is 6 liters or less.

15. A flush toilet bowl as claimed in claim 13, wherein the water passage connecting the discharge port to the toilet bowl includes a jet water path that connects the discharge port of said flush water tank to a jet water delivery port provided facing the inlet of said discharge trap;

said jet water path having a bent part turning the direction of flow toward the jet water delivery port before the jet water delivery port, and said jet water delivery port being provided in the vicinity thereof with a means for revising a distribution of the velocity of flow, said means performing the revision of the distribution of the velocity of flow so that the velocity of flow substantially in the center of the jet water delivery port becomes the maximum.

16. A flush toilet bowl as claimed in claim 13, wherein the gathered water part between said second weir and the lower end of said descending channel is formed so as to provide a ventialtion space above the gathered water part, and the horizontal part is provided substantially at the level of ⅔ the distance from said surface of the gathered water to said ventilating space.

17. A flush toilet bowl as claimed in claim 13, wherein the first weir is formed having a radius of curvature which is 0.9 to 1.4 times as large as the diameter of the discharge trap.

18. A flush toilet bowl as claimed in claim 13, wherein the descending channel of the discharge trap is substantially in the form of a cylinder having a length of 100 to 150 mm and extending substantially in the vertically downward direction from the first weir.

19. A flush toilet bowl as claimed in claim 13, wherein the second weir and the discharge opening of the cross-laid channel continue by way of a downward bent part, and said downward bent part is formed having a radius of curvature which is 0.7 to 1.2 times as large as the diameter of the discharge trap.

20. A flush toilet bowl as claimed in claim 13, wherein the discharge trap is substantially identical in the cross sectional area from the inlet thereof to the discharge opening.

21. A flush toilet bowl as claimed in claim 13, wherein the discharge port has a diameter between 70 and 75 mm.

22. A flush toilet bowl as claimed in claim 13, wherein the valve body is arranged and supported so as to begin moving toward the closed position without delay upon release of the force transmitting member by the user.

23. A flush toilet bowl as claimed in claim 13, wherein the valve body and support arm are arranged such that the total weight supported on the support arm remains essentially unchanged throughout operation.

24. A flush toilet bowl as claimed in claim 13, wherein the valve body is disc shaped and supported at the end of the support arm.

25. A flush toilet bowl as claimed in claim 13, wherein an overflow tube is provided in the flush water tank and the support arm is pivotally supported to overflow tube.

26. A flush toilet bowl as claimed in claim 13, wherein the valve body is supported on a plurality of support arms.

27. A flush toilet bowl as claimed in claim 13, wherein the support arm has first and second ends and the support arm is pivotably supported within the tank at a location between the first and second ends of the support arm so that, when viewed in a plane transverse to the pivot axis, the support arm has a first end portion on one side of the support arm pivot axis and a second end portion on the other side of the support arm pivot axis and wherein the valve body is supported on the first end portion of the support arm and the location of the support arm pivot axis is such that the total weight supported on the first end portion of the support arm is always greater than the total weight supported on the second end portion of the support arm.

28. A flush toilet bowl as claimed in claim 27, further comprising means for a counter balance on the second end portion of the support arm so as to adjust the total weight supported on the second end portion.

29. In a flush toilet of the type comprising a toilet bowl body having a bowl part and a discharge trap extending from a location proximate the bottom of the bowl part, the bowl part having a rim portion that has an upper rim surface; a flush water tank disposed at the back of said toilet bowl body, the flush water tank including a discharge port that opens into the flush water tank at a predetermined level; a valve assembly for sealing the discharge port so as to prevent the discharge of flush water from the tank, the valve assembly including a valve body that is movable between a closed position wherein the valve body blocks the discharge opening so as to prevent the discharge of flush water from the tank and an open position wherein the valve body is spaced from the discharge port so that flush water may be discharged from the tank through the discharge port, the valve assembly, including a valve body having a predetermined weight, the valve body being supported on a support arm having a predetermined weight so that the support arm has a center of gravity, the support arm being pivotably supported within the tank about an axis that is spaced from the valve body; and the weight of the valve body and support arm being arranged relative to the pivot axis such that the valve body is always biased into the closed position the valve assembly further comprising a force transmitting member that is actuatable by a user to move the valve body from the closed position to the open position to initiate flushing; and a water passage connecting the discharge port to the toilet bowl;

a process for improving flushing performance while using a predetermined volume of water, the process comprising the steps of:

supporting the predetermined volume of water in a the flush water tank with additional water above the level of the discharge port so that the total volume of water contained above the level of the discharge port in the tank is greater than the predetermined volume;

moving the valve body from the closed position to the open position upon actuation of the force transmitting member by the user to initiate flushing so as to discharge the predetermined volume of water through the discharge port, while maintaining the valve body in a position whereby the weight of the valve body and support arm bias the valve body into the closed position;

moving the valve body to the closed position without delay upon release of the force transmitting member by the user so as to prevent the discharge of flush water from the tank before additional water located above the level of the discharge port is discharged through the discharge port;

whereby only the predetermined volume of water, which is less than the total volume of water above the level of the discharge port, is discharged through the discharge port so that the difference between the volume of water that is located above the level of the discharge port and predetermined volume of water, which is actually discharged through the discharge port is used to pressurize the water that is actually discharged.

30. The process of claim 29, further comprising the steps of:

guiding water through a jet water path that extends from the discharge port to the a jet water delivery port provided facing the inlet of said discharge trap, wherein the jet water path has a bent part turning the direction of flow toward the jet water delivery port before the jet water delivery port; and revising the distribution of the velocity of flow so that the velocity of flow substantially in the center of the jet water delivery port becomes the maximum.

31. A flush toilet bowl as claimed in claim 1, wherein the valve body and support arm are arranged such that the total weight supported on the support arm remains essentially unchanged throughout operation.

32. A flush toilet bowl as claimed in claim 1, wherein the valve body is disc shaped and supported at the end of the support arm.

33. A flush toilet bowl as claimed in claim 1, wherein an overflow tube is provided in the flush water tank and the support arm is pivotally supported to overflow tube.

34. A flush toilet bowl as claimed in claim 1, wherein the valve body is supported on a plurality of support arms.

35. A flush toilet bowl as claimed in claim 1, wherein the support arm has first and second ends and the support arm is pivotably supported within the tank at a location between the first and second ends of the support arm so that, when viewed in a plane transverse to the pivot axis, the support arm has a first end portion on one side of the support arm pivot axis and a second end portion on the other side of the support arm pivot axis and wherein the valve body is supported on the first end portion of the support arm and the location of the support arm pivot axis is such that the total weight supported on the first end portion of the support arm is always greater than the total weight support on the second end portion of the support arm.

36. A flush toilet bowl as claimed in claim 35, further comprising means for a counter balance on the second end portion of the support arm so as to adjust the total weight supported on the second end portion.

* * * * *